US007130564B2

(12) United States Patent
Murakami et al.

(10) Patent No.: US 7,130,564 B2
(45) Date of Patent: Oct. 31, 2006

(54) METHOD AND APPARATUS FOR IMAGE FORMING CAPABLE OF REMOVING RESIDUAL TONER WITHOUT USING A TONER CLEANING SYSTEM, PROCESS CARTRIDGE FOR USE IN THE APPARATUS AND TONER USED FOR THE IMAGE FORMING

(75) Inventors: Eisaku Murakami, Tokyo (JP); Toshio Koike, Kanagawa-ken (JP); Masato Yanagida, Tokyo (JP); Naohiro Kumagai, Kanagawa-ken (JP); Takeshi Shintani, Kanagawa-ken (JP); Masanori Kawasumi, Kanagawa-ken (JP); Atsushi Sampe, Kanagawa-ken (JP); Masami Tomita, Shizuoka-ken (JP); Hiroyuki Nagashima, Kanagawa-ken (JP); Takeshi Uchitani, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/874,269

(22) Filed: Jun. 24, 2004

(65) Prior Publication Data

US 2005/0036805 A1 Feb. 17, 2005

(30) Foreign Application Priority Data

Jun. 24, 2003 (JP) ..... 2003-179390

(51) Int. Cl.
*G03G 15/00* (2006.01)
*G03G 21/00* (2006.01)

(52) U.S. Cl. ..... 399/129; 399/99; 399/149; 399/354; 430/110.3; 430/110.4; 430/125

(58) Field of Classification Search ..... 399/128, 399/129, 149, 150, 353, 354, 71, 99, 101, 399/343; 430/110.1, 110.3, 110.4, 125
See application file for complete search history.

(56) References Cited

U.S. PATENT DOCUMENTS

| | | | |
|---|---|---|---|
| 4,562,136 | A | 12/1985 | Inoue et al. |
| 4,590,141 | A | 5/1986 | Aoki et al. |
| 4,758,489 | A | 7/1988 | Tomita et al. |
| 4,762,763 | A | 8/1988 | Nomura et al. |
| 4,888,263 | A | 12/1989 | Tomita et al. |
| 4,931,374 | A | 6/1990 | Tomita et al. |
| 4,969,015 | A | 11/1990 | Sanpe |

(Continued)

FOREIGN PATENT DOCUMENTS

JP 05-188637 * 7/1993

OTHER PUBLICATIONS

U.S. Appl. No. 11/207,819, filed Aug. 22, 2005, Shintani et al.

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus includes an image bearing member configured to form an electrostatic latent image on a surface thereof, and a separating mechanism configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member.

50 Claims, 7 Drawing Sheets

U.S. PATENT DOCUMENTS 4,984,024 A 1/1991 Ohkaji et al.
5,124,757 A * 6/1992 Ikegawa ..... 399/148
5,164,774 A 11/1992 Tomita et al.
5,184,184 A 2/1993 Hayashi et al.
5,225,303 A 7/1993 Tomita et al.
5,244,765 A 9/1993 Katoh et al.
5,287,158 A 2/1994 Nagashima et al.
5,386,274 A 1/1995 Sanpe et al.
5,396,319 A 3/1995 Tokuhashi et al.
5,474,869 A 12/1995 Tomita et al.
5,486,909 A 1/1996 Takenaka et al.
5,489,747 A 2/1996 Takenaka et al.
5,517,289 A * 5/1996 Ito et al. ..... 399/149
5,552,870 A 9/1996 Murakami et al.
5,597,311 A 1/1997 Yanagida et al.
5,600,428 A 2/1997 Yanagida
5,610,693 A 3/1997 Sugiyama et al.
5,614,998 A 3/1997 Sanpe
5,617,191 A 4/1997 Murakami et al.
5,625,438 A 4/1997 Sugiyama et al.
5,625,439 A 4/1997 Murakami
5,625,440 A 4/1997 Matsumae et al.
5,625,441 A 4/1997 Sugiyama et al.
5,638,158 A 6/1997 Sanpe et al.
5,663,788 A 9/1997 Sanpe
5,666,625 A 9/1997 Komatsubara et al.
5,689,782 A 11/1997 Murakami et al.
5,697,026 A 12/1997 Matsumae et al.
5,701,570 A * 12/1997 Takuma ..... 399/343
5,708,942 A 1/1998 Sugiyama et al.
5,721,083 A 2/1998 Masuda et al.
5,734,952 A 3/1998 Murakami et al.
5,740,494 A * 4/1998 Shoji et al. ..... 399/71
5,761,594 A 6/1998 Seto et al.
5,768,665 A 6/1998 Yamanaka et al.
5,775,918 A 7/1998 Yanagida et al.
5,826,144 A 10/1998 Takenaka et al.
5,840,456 A 11/1998 Tomita et al.
5,845,183 A 12/1998 Sugiyama et al.
5,851,716 A 12/1998 Kuramoto et al.
5,879,752 A 3/1999 Murakami et al.
5,881,339 A 3/1999 Yanagida et al.
5,897,243 A 4/1999 Komatsubara et al.
5,915,156 A 6/1999 Kizaki et al.
5,970,282 A 10/1999 Yanagida et al.
5,975,446 A 11/1999 Yaguchi et al.
5,995,789 A 11/1999 Murakami et al.
5,999,772 A 12/1999 Kakitani et al.
6,023,342 A 2/2000 Yanagida
6,026,255 A 2/2000 Kizaki et al.
6,032,006 A 2/2000 Yanagida
6,033,818 A 3/2000 Sugiyama et al.
6,064,845 A * 5/2000 Suzuki ..... 399/170
6,072,977 A 6/2000 Murakami
6,074,794 A 6/2000 Fushimi et al.
6,103,441 A 8/2000 Tomita et al.
6,269,228 B1 7/2001 Kayahara et al.
6,363,229 B1 3/2002 Shiraishi et al.
6,505,024 B1 1/2003 Kayahara et al.
6,539,189 B1 3/2003 Yanagida
6,597,881 B1 7/2003 Hatori et al.
6,601,991 B1 8/2003 Sampe
6,640,076 B1 10/2003 Shintani
6,654,574 B1 11/2003 Kayahara et al.
6,660,443 B1 12/2003 Sugiyama et al.
6,665,512 B1 12/2003 Yanagida et al.
6,682,866 B1 1/2004 Sugiyama et al.
6,687,474 B1 2/2004 Yamada et al.
6,701,118 B1 3/2004 Kayahara et al.
6,740,460 B1 5/2004 Tomita et al.
6,756,175 B1 6/2004 Emoto et al.
6,787,280 B1 9/2004 Yamashita et al.
2001/0019805 A1* 9/2001 Ohba et al. ..... 430/110.4
2001/0026694 A1* 10/2001 Sakaizawa et al. ..... 399/50
2001/0044059 A1 11/2001 Miyamoto et al.
2002/0098436 A1 7/2002 Miyamoto et al.
2002/0159798 A1* 10/2002 Yamamoto et al. ..... 399/284
2004/0076901 A1 4/2004 Miyamoto et al.
2004/0131381 A1* 7/2004 Kawasumi et al. ..... 399/353 X

OTHER PUBLICATIONS

U.S. Appl. No. 11/226,197, filed Sep. 15, 2005, Kimura et al.
U.S. Appl. No. 11/289,488, filed Nov. 30, 2005, Shimojo et al.

* cited by examiner

METHOD AND APPARATUS FOR IMAGE FORMING CAPABLE OF REMOVING RESIDUAL TONER WITHOUT USING A TONER CLEANING SYSTEM, PROCESS CARTRIDGE FOR USE IN THE APPARATUS AND TONER USED FOR THE IMAGE FORMING

CROSS REFERENCE TO RELATED APPLICATIONS

The present patent document claims priority under 35 U.S.C. § 119 to Japanese Patent Application No. 2003-179390 filed on Jun. 24, 2003 in the Japanese Patent Office, the entire contents of which are hereby incorporated herein by reference.

BACKGROUND OF THE INVENTION

1. Field of the Invention

The present invention relates to a method and apparatus for image forming, a process cartridge included in the apparatus and toner used for the image forming, and more particularly to a method and apparatus for image forming capable of efficiently collecting toner remaining on image forming components without using a cleaning device for preventing a reproduction of a defective reproduction having a background contamination and dust.

2. Description of the Related Art

An image forming apparatus, such as a copying machine, a facsimile machine, a printing machine, and so forth using an electrostatic transfer method generates a transfer electric field between an image bearing member and an intermediate transfer member that travels in contact with the image bearing member. A toner image formed on a surface of the image bearing member is transferred onto the intermediate transfer member. In some other image forming apparatuses, a transfer electric field is generated between the image bearing member and a recording medium that also travels in contact with the image bearing member. The toner image formed on the surface of the image bearing member is also transferred onto the recording medium. With the electrostatic transfer method, residual toner remains on the surface of the image bearing member after the transferring operation of an image forming process. In a next image forming process, when a laser beam irradiates the image bearing member having the residual toner on the surface thereof, electric charges applied on the areas covered by the residual toner cannot be grounded, resulting in producing a defective image having a white spot, for example.

To prevent such a defective image, a cleaning device for removing residual toner from the image bearing member is disposed at a position opposite to the image bearing member between a transferring area and a charging area so that the residual toner can be removed. However, this requires additional space in the image forming apparatus since the cleaning device includes a toner collecting tank for collecting the residual toner removed from the image bearing member and a recycled toner conveying path for conveying the recycled residual toner for reusing in the image forming apparatus. Therefore, the background image forming apparatus becomes large in size and brings about an increase in costs due to an increase of the number of parts.

According to a strong demand in the market requiring a high speed performance in operations of color image forming, a tandem color image forming apparatus has been introduced, which is provided with a plurality of image bearing members for respective colors. In such a tandem color image forming apparatus, a plurality of cleaning devices are provided corresponding to the respective image bearing members. However, the tandem color image forming apparatus may be larger in size and more expensive in part cost.

Recently, a charging device employing a charging method using a charging roller has been proposed. In the above-described charging device, the charging roller is held in contact with the image bearing member. In some other charging device, the charging roller is disposed in a vicinity of the image bearing member. There is another charging method also commonly known such as a corotron or scrotron method using corona, for example, which is referred to as a corona discharge method. The corona discharge method causes a corona discharge to charge the surface of the image bearing member. However, the corona discharge method needs a large amount of corona discharge so that the surface of the image bearing member is charged to a desired potential. The corona discharge produces hazardous products such as ozone and NOx that adhere to the surface of the image bearing member, causing an image defect such as image deletion. On the contrary, the charging roller produces a lesser amount of hazardous products.

To reduce the size, the image forming apparatus may apply a cleaner-less system. For example, a technique has been proposed such that an image forming apparatus uses a developing device provided therein for collecting residual toner remaining on a surface of an image bearing member. This technique is referred to as a developing and cleaning method. The developing and cleaning method utilizes the developing device, which functions as a developing device at the same time as a cleaning device. With the developing and cleaning method, the image forming apparatus does not need to include an additional cleaning device. Therefore, the developing and cleaning method can contribute to reduction in size and cost of the image forming apparatus.

However, the image forming apparatus employing the developing and cleaning method and the charging roller method may allow the residual toner to contact a charging member when the residual toner remaining on the image bearing member is conveyed to the developing area. When the residual toner contacts the charging member, it adheres on a surface of the charging member to disturb a charging onto the image bearing member, so that the charging cannot provide a surface of the image bearing member with a desired potential or may cause a charging failure such as a charging nonuniformity. Consequently, an image defect including deterioration of image density and a background contamination may occur in producing an image.

Several attempts have been made to use a developing bias for the purpose of collecting residual toner. The developing bias is applied in a non-image forming operation as well as in an image forming operation, to collect residual toner remaining on a surface of an image bearing member. During the non-image forming operation, a paper jam is recovered, for example.

The above-described attempts, however, may fail to sufficiently collect the residual toner and, at the same time, may cause a charging failure such as a charging nonuniformity, which leads to a defective image having deterioration of the image density and a background contamination.

SUMMARY OF THE INVENTION

The present invention has been made under the above-described circumstances.

An object of the present invention is to provide a novel image forming apparatus capable of effectively removing irregular charged toner remaining on an image bearing member and a charging member without using a cleaning device, to minimize any defective image having a background contamination and dust thereon.

Another object of the prevent invention is to provide a novel process cartridge for use in an image forming apparatus to minimize any defective image having a background contamination and dust.

Another object of the present invention is to provide novel toner used in an image forming apparatus to minimize any defective image having a background contamination and dust thereon.

In one exemplary embodiment, a novel image forming apparatus includes an image bearing member and a separating mechanism. The image bearing member is configured to form an electrostatic latent image on a surface thereof. The separating mechanism is configured to separate irregular charge toner from residual toner remaining on the surface of the image bearing member after a completion of an image forming process, to provide an extra travel passage to give a time delay to the irregular charge toner, and to return the irregular charge toner with the time delay to the surface of the image bearing member.

The above-described novel image forming apparatus may further include a charging member and a collecting mechanism. The charging member is configured to supply a charging bias to the surface of the image bearing member. The collecting mechanism is configured to collect the irregular charge toner returned from the separating mechanism after the irregular charge toner passes a charging area formed between the charging member and the image bearing member.

The irregular charge toner may have a positive polarity.

The irregular charge toner may have a negative polarity.

The above-described novel image forming apparatus may further include a drive mechanism configured to drive the separating mechanism in a direction of rotation of the image bearing member, and the drive mechanism may control a rotation speed of the separating mechanism to be variable.

The separating mechanism may include a brush roller having a peripheral surface including the extra travel passage and a part of which peripheral surface is held in contact with a surface of the image bearing member.

The separating mechanism may give a predetermined bias to the image bearing member so that the irregular charge toner deposited to the charging member is released therefrom to the image bearing member.

The above-described novel image forming apparatus may further include a power source configured to supply a collecting bias to the brush roller so that the irregular charge toner is attracted to the separating mechanism and a discharging bias to the brush roller so that the irregular charge toner is returned to the image bearing member.

The brush roller may rub the surface of the image bearing member while the brush roller rotates in the direction of rotation of the image bearing member.

The charging member may stop supplying the charging bias when the separating mechanism gives a predetermined bias to the image bearing member.

The charging member may be grounded when the separating mechanism gives a predetermined bias to the image bearing member.

The above-described novel image forming apparatus may further include a developing mechanism configured to develop a toner image based on the electrostatic latent image formed on the surface of the image bearing member and a transferring mechanism configured to transfer the toner image from the image bearing member. At least one of the developing mechanism and the transferring mechanism may include the collecting mechanism.

The transferring mechanism may include a cleaning mechanism configured to clean off a surface of the transferring mechanism when the transferring mechanism includes the collecting mechanism and collects the irregular charge toner.

The image bearing member and the separating mechanism may be integrally formed in a detachable process cartridge.

In one exemplary embodiment, a novel method for image forming includes separating an irregular charge toner from a residual toner remaining on a surface of an image bearing member after a completion of an image forming process, giving a time delay to the irregular charge toner, and returning the irregular charge toner with the time delay to the surface of the image bearing member.

The above-described novel method may further include charging the surface of the image bearing member with a charging bias, and collecting the irregular charge toner after the irregular charge toner passes a charging area formed between the charging member and the image bearing member.

The above-described novel method may further include driving for performing the separating in a direction of rotation of the image bearing member, and controlling a rotation speed in the separating to be variable.

The separating may separate the irregular charge toner with a brush roller having a surface portion held in contact with a surface of the image bearing member.

The separating may give a predetermined bias to the image bearing member so that the irregular charge toner deposited to the charging member is released therefrom to the image bearing member.

The above-described novel image forming method may further include supplying a collecting bias to the brush roller so that the irregular charge toner is attracted in the separating and a discharging bias to the brush roller so that the irregular charge toner is returned to the image bearing member.

The supplying may stop supplying the charging bias when the separating gives the predetermined bias to the image bearing member.

The collecting may further include developing, with a developing mechanism, a toner image based on the electrostatic latent image formed on the surface of the image bearing member and transferring, with a transferring mechanism, the toner image from the image bearing member. At least one of the developing and the transferring performs the collecting.

The transferring mechanism may include a cleaning mechanism configured to clean off a surface of the transferring mechanism when the transferring mechanism performs the collecting and collects the irregular charge toner.

The separating, giving, returning, charging, collecting, driving, controlling, developing, and transferring may be performed in a detachable process cartridge.

In one exemplary embodiment, another novel image forming apparatus includes an image bearing member and a separating mechanism. The image bearing member is configured to bear a toner image using a toner on a surface thereof. The separating mechanism is configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member. The toner has a volume-based average particle diameter Dv in a range from approximately 3 μm to approximately 8 μm and a distribution Ds in a range from approximately 1.05 to approximately 1.40. The distribution Ds may be defined by a ratio of the volume-based average particle diameter Dv to a number-based average particle diameter Dn, expressed as Dv/Dn.

In one exemplary embodiment, a novel process cartridge for use in an image forming apparatus includes an image bearing member and a separating mechanism. The image bearing member is configured to form an electrostatic latent image on a surface thereof. The separating mechanism is configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member.

In one exemplary embodiment, a novel toner used in an image forming apparatus includes a resin, a colorant, a charge control agent, and a releasing agent. The above-described novel toner has a volume-based average particle diameter Dv in a range from approximately 3 μm to approximately 8 μm and a distribution Ds in a range from approximately 1.05 to approximately 1.40. The distribution Ds may be defined by a ratio of the volume-based average particle diameter Dv to the number-based average particle diameter Dn, expressed as Dv/Dn. The image forming apparatus using the novel toner may include an image bearing member configured to form an electrostatic latent image on a surface thereof, and a separating mechanism configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member.

The above-described novel toner may have a shape factor SF1 in a range of approximately 100 to approximately 180 and a shape factor SF2 in a range of approximately 100 to approximately 180.

The above-described novel toner may have a spindle shape.

The above-described novel toner may have a ratio of a major axis r1 to a minor axis r2 is in a range from approximately 0.5 to approximately 1.0 and a ratio of a thickness r3 to the minor axis r2 is in a range from approximately 0.7 to approximately 1.0, and satisfies a relationship of $r1 \geqq r2 \geqq r3$.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
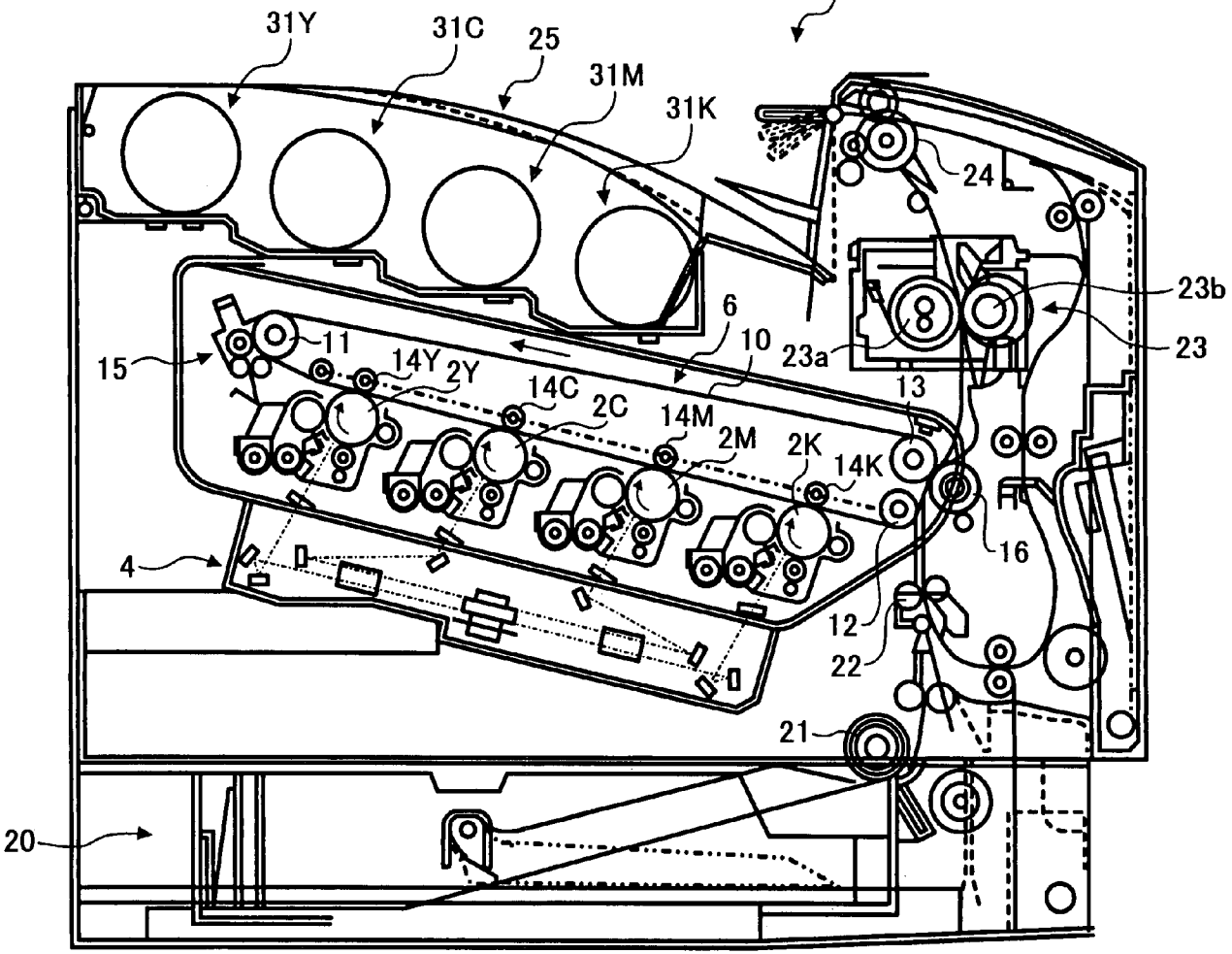
FIG. 1 is a schematic cross-sectional view of an image forming apparatus according to an exemplary embodiment of the present invention.

Referring now to the drawings, wherein like reference numerals designate identical or corresponding parts throughout the several views.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, an image forming apparatus 1 is shown as one example of an electrophotographic image forming apparatus according to an exemplary embodiment of the present invention. The image forming apparatus 1 of FIG. 1 employs a tandem system forming a color image with toners of four different colors such as yellow (Y), cyan (C), magenta (M) and black (BK).

The image forming apparatus 1 generally includes four photoconductive drums 2Y, 2C, 2M and 2K as an image forming mechanism, four toner bottles 31Y, 31C, 31M and 31K as a toner feeding mechanism, an optical writing device 4, a transfer device 6 as a transfer mechanism, a sheet feeding cassette 20 as a sheet feeding mechanism and a fixing device 23 as a fixing mechanism.

The photoconductive drums 2Y, 2C, 2M and 2K are separately arranged at positions having different heights in a stepped manner and rotate in a direction as indicated by arrows in FIG. 1. Each of the photoconductive drums 2Y, 2C, 2M and 2K includes a cylindrical conductive body having a relatively thin base. A photoconductive layer is formed on the conductive body and a protecting layer covers it. An intermediate layer may be applied between the photoconductive layer and the protecting layer. In this embodiment, a drum type image bearing member is used such as the photoconductive drums 2Y, 2C, 2M and 2K. However, as an alternative, a belt type image bearing member may be applied as well.

The toner bottles 31Y, 31C, 31M and 31K are separately provided with respect to the photoconductive drums 2Y, 2C, 2M and 2K at an upper portion of the image forming apparatus 1 and detachably arranged to the image forming apparatus 1 so that any one of the toner bottles 31Y, 31C, 31M and 31K may separately be replaced, for example, at its toner empty state.

The optical writing device 4 is arranged below the photoconductive drums 2Y, 2C, 2M and 2K and emits laser beams towards the respective photoconductive drums 2Y, 2C, 2M and 2K.

The transfer device 6 is arranged above the photoconductive drums 2Y, 2C, 2M and 2K and includes an intermediate transfer belt 10, supporting rollers 11, 12 and 13, primary transfer rollers 14Y, 14C, 14M and 14K, and a belt cleaning device 15. The intermediate transfer belt 10 is supported by the supporting rollers 11, 12 and 13, and is held in contact with the primary transfer rollers 14Y, 14C, 14M and 14K according to the photoconductive drums 2Y, 2C, 2M and 2K. The intermediate transfer belt 10 is held in contact with the photoconductive drums 2Y, 2C, 2M and 2K and travels in a same direction the photoconductive drums 2Y, 2C, 2M and 2K rotate, as indicated by an arrow shown in FIG. 1.

A sheet feeding mechanism is provided at a lower portion of the image forming apparatus 1 and includes the sheet feeding cassette 20, a sheet feeding roller 21, a registration roller pair 22, and a secondary transfer roller 16.

The fixing device 23 is provided at an upper right portion of the image forming apparatus 1 of FIG. 1 and includes a heat roller 23*a* and a pressure roller 23*b*. After a recording medium is processed in the fixing device 23, the recording medium is discharged by a sheet discharging roller 24 to outside onto a sheet discharging tray 25 of the image forming apparatus 1.

As described above, the photoconductive drums 2Y, 2C, 2M and 2K are held in contact with the intermediate transfer belt 10 and are rotated in a same direction the intermediate transfer belt travels in FIG. 1. Each of the photoconductive drums 2Y, 2C, 2M and 2K has respective components around it. Since the photoconductive drums 2Y, 2C, 2M and 2K have similar structures and functions to each other, except the fact that the toners are of different colors, FIG. 2 exemplarily illustrates the photoconductive drum 2Y and its related components.

Figure 2:
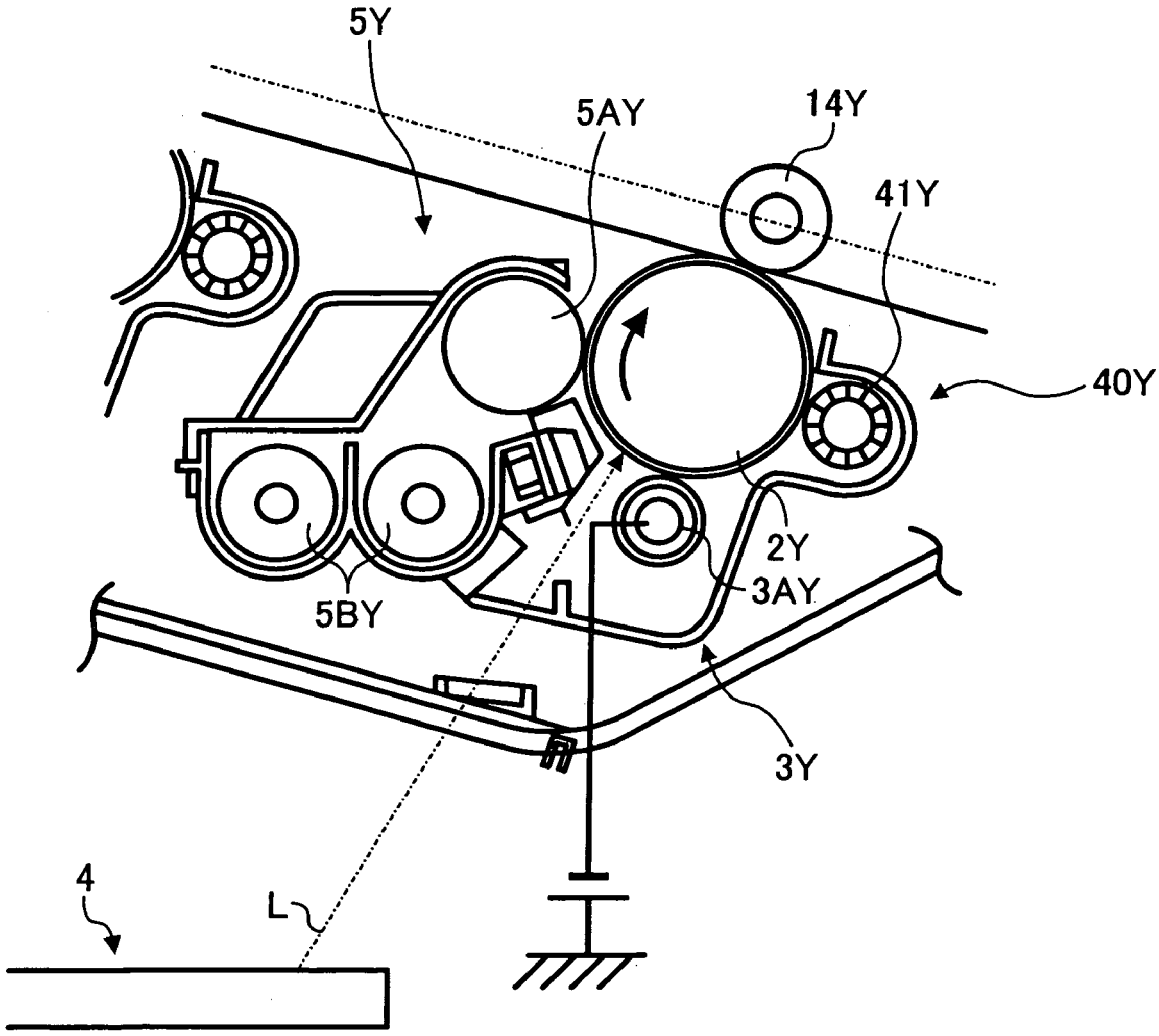
FIG. 2 is a schematic cross-sectional view of an image bearing member and image forming components arranged around the image bearing member in the image forming apparatus of FIG. 1.

In FIG. 2, the components disposed around the photoconductive drum 2Y are a charging device 3Y, a developing device 5Y, and a temporary toner storing mechanism 40Y.

The charging device 3Y is applied with a charged voltage to uniformly charge a surface of the photoconductive drum 2Y to a predetermined polarity, which is a negative polarity in this embodiment. As an alternative, the photoconductive drum 2Y may be charged to a positive polarity as a regular polarity.

In the description below, the negative polarity as a predetermined polarity of this embodiment is referred to as a "regular polarity".

In the description below, a toner charged to a irregular charge toner is referred to as a "regular charge toner T0" (see FIG. 4).

The charging device 3Y includes a charging roller 3AY and a cleaning brush (not shown). The charging roller 3AY is used in a method to charge the surface of the photoconductive drum 2Y by using a charging roller, that is, the charging roller method. In the charging roller method, the charging device 3Y causes the charging roller 3AY to contact the photoconductive drum 2Y so that the charging roller 3AY can charge the surface of the photoconductive drum 2Y to the regular polarity. As an alternative, it is possible that the charging device 3Y causes the charging roller 3AY to be placed in the vicinity of the photoconductive drum 2Y. The charging device 3Y applies a direct current bias so that the photoconductive drum 2Y is charged with a surface potential of, e.g., −500V. As an alternative, the charging device 3Y may apply a bias generated by a current that includes a direct current and a superimposed alternating current.

The cleaning brush (not shown) cleans off a surface of the charging roller 3AY. Even with a relatively small amount of toner remaining on the surface of the charging roller 3AY, a charging failure such as a charging nonuniformity may occur. To prevent the above-described failure, the cleaning brush (not shown) needs to clean remaining toner off the surface of the charging roller 3AY.

The charging roller 3AY in this embodiment using the contact type charging method is held in contact with the photoconductive drum 2Y for charging. In a case where the non-contact type charging method is applied, two ends of the charging roller 3AY opposite to each other may be wrapped with a thin film around predetermined areas of the ends in an axial direction of the charging roller 3AY, so that the predetermined areas of the ends of the charging roller 3AY are held in contact with the photoconductive drum 2Y. But an area of the surface of the charging roller 3AY between the predetermined areas is distant from the photoconductive drum 2Y and forms a predetermined contact gap against the surface of the photoconductive drum 2Y.

With the above-described structure, the predetermined contact gap has a thickness of the thin film rolled around the both ends of the charging roller 3AY. When a charge bias is applied to the charging roller 3AY, a discharge may be generated between the surface of the charging roller 3AY and the surface of the photoconductive drum 2Y, and thus the surface of the photoconductive drum 2Y is charged.

As shown in FIG. 1, the optical writing device 4 emits four laser beams to the photoconductive drums 2Y, 2C, 2M and 2K. In FIG. 2, an exemplary laser beam L according to image data corresponding to yellow color irradiates the photoconductive drum 2Y through a path formed between the charging device 3Y and the developing device 5Y, so that an electrostatic latent image is formed. As an alternative, the optical writing device 4 can adapt a LED method in place of the laser beam method.

As shown in FIG. 1, the toner bottles 31Y, 31C, 31M and 31K, as described above, any one of which can independently be detachable from the others, are arranged above the intermediate transfer belt 10. In the embodiment of the present invention, developer from the toner bottle 31Y is a two-component developer with toner and carriers. As an alternative, the developer may be a one-component developer with toner without the carriers. The toner bottles 31Y, 31C, 31M and 31K are separately provided with respect to the respective photoconductive drums 2Y, 2C, 2M and 2K, and detachably arranged to the color image forming apparatus 1.

With the above-described structure of each toner bottle (e.g., 31Y), each toner bottle alone may easily be replaced with a new toner bottle when the toner bottle is detected as being in a toner empty state, for example. This avoids an unnecessary replacement of components associated with the toner bottle replaced, and avoids replacing components that are not at ends of their useful lives. Thereby, other components associated with each toner bottle may be used until their useful lives end, thus contributing to a cost reduction.

As shown in FIG. 2, the developing device 5Y includes a developing roller 5AY and toner agitating screws 5BY.

The developing roller 5AY is a developer bearing member, and a part of the developing roller 5AY is disposed outside at an opening of a casing of the developing device 5Y.

The toner agitating screws 5BY agitate toner supplied from the toner bottle 31Y together with carriers contained in the developing device 5Y, before conveying the agitated toner towards the developing roller 5AY.

The developing roller 5AY includes a magnet roller (not shown) and a developing sleeve (not shown). The magnet roller generates a magnetic field and the developing sleeve is coaxially rotated around the magnet roller.

The carrier in the developer is magnetized by a magnetic force generated by the magnet roller to rise in the form of a magnet brush on a surface of the developing roller 5AY. The carrier is then conveyed to a developing area where the developing roller 5AY and the photoconductive drum 2Y are oppositely disposed. In the developing area, the developing roller 5AY has a linear velocity faster than that of the photoconductive drum 2Y, and the surface of the developing roller 5AY moves in a same direction that the surface of the photoconductive drum 2Y travels. The carrier rising in the form of the magnet brush on the surface of the developing roller 5AY rubs the surface of the photoconductive drum 2Y and transfers the toner adhering on the surface of the carrier to the surface of the photoconductive drum 2Y. At this time, a power source (not shown) applies a voltage of −300V to the developing roller 5AY to generate a developing electric field in an area between the developing device and the photoconductive drum 2Y, which area is referred to as a "developing area". The developing electric field generates an electrostatic force between the electrostatic latent image formed on the surface of the photoconductive drum 2Y and the surface of the developing roller 5AY such that the toner on the surface of the developing roller 5AY is attracted to the photoconductive drum 2Y having the electrostatic latent image on the surface thereon. The attraction of the toner makes the electrostatic latent image formed on the photoconductive drum 2Y visualize as a single color toner image. The developing roller 5AY is connected to a drive motor (not shown) via a clutch (not shown) such that the clutch can temporarily stop a rotation of the developing roller 5AY.

In the transferring device 6 as shown in FIG. 1, the intermediate transfer belt 10 is arranged above the photoconductive drums 2Y, 2C, 2M and 2K and is supported by the supporting rollers 11, 12 and 13. The intermediate transfer belt 10 forms an endless belt extended with the supporting rollers 11, 12 and 13, rotating in a direction, indicated by an arrow in FIG. 1, by a motor (not shown). The toner images of different colors are transferred one after another onto the intermediate transfer belt 10 to form an overlaid full-color image. The operation is performed with an electrophotographic transfer method. The electrophotographic transfer method may require a transfer charger. However, the electrophotographic transfer method used in the embodiment uses a transfer roller which generates less transfer dust than the method using a transfer charger.

The intermediate transfer belt 10 is held in contact with the primary transfer rollers 14Y, 14C, 14M and 14K corresponding to the photoconductive drums 2Y, 2C, 2M and 2K, respectively, to form primary transfer nips between the photoconductive drum 2Y and the primary transfer roller 14Y, between the photoconductive drum 2C and the primary transfer roller 14C, and so forth. Corresponding to the photoconductive drum 2Y, the primary transfer roller 14Y is arranged at a position opposite to the photoconductive drum 2Y such that the toner image formed on the surface of the photoconductive drum 2Y is transferred onto the intermediate transfer belt 10. The primary transfer roller 14Y receives a transfer voltage having an irregular polarity, which is an opposite polarity to the regular polarity, to the charged toner so as to transfer it to the inside surface of the intermediate transfer belt 10. Through operations similar to those as described above, cyan, magenta and black images are formed on the surfaces of the respective photoconductive drums 2C, 2M and 2K. Those color toner images are sequentially overlaid on the surface of the intermediate transfer belt 10 on which the yellow toner image is already formed, such that a primary overlaid toner image is formed on the surface of the intermediate transfer belt 10.

After the toner images in different colors are sequentially transferred on the intermediate transfer belt 10, the belt cleaning device 15 removes the residual toners remaining on the surface of the intermediate transfer belt 10. The belt cleaning device 15 includes a fur brush (not shown) and a cleaning blade (not shown) for effectively removing the residual toner from the surfaces of the intermediate transfer belt 10 and collecting the residual toner into a toner collecting tank (not shown).

In FIG. 1, the sheet feeding cassette 20 accommodates a plurality of recording media such as transfer sheets that include an individual transfer sheet. The sheet feeding roller 21 and the registration roller pair 22 form a sheet conveying portion. The sheet feeding roller 21 is held in contact with the transfer sheet. When the sheet feeding roller 21 is rotated by a drive motor (not shown), the transfer sheet placed on the top of a stack of transfer sheets in the sheet feeding cassette 20 is fed and is conveyed to a portion between rollers of the registration roller pair 22. The registration roller pair 22 stops and feeds the transfer sheet in synchronization with a movement of the four-color toner image towards a secondary transfer area, which is a secondary nip portion formed between the intermediate transfer belt 10 and a secondary transfer roller 16. The secondary transfer roller 16 is applied with an adequate predetermined transfer voltage to a positive polarity such that the four-color image, formed on the surface of the intermediate transfer belt 10, is transferred onto the transfer sheet.

The transfer sheet that has the four-color image thereon is conveyed further upward and passes between a pair of fixing rollers of the fixing device 23. The fixing device 23 includes the heat roller 23*a* having a heater therein and the pressure roller 23*b* for pressing the transfer sheet for fixing the four-color image. The fixing device 23 fixes the four-color image to the transfer sheet by applying heat and pressure. After the transfer sheet passes the fixing device 23, the transfer sheet is discharged by the sheet discharging roller 24 to the sheet discharging tray 25 provided at the upper portion of the color image forming apparatus 1. The belt cleaning device 15 removes the residual toner adhering on the surface of the intermediate transfer belt 10.

The color image forming apparatus 1 according to the embodiment of the present invention includes a temporary toner storing mechanism 40Y and a toner collecting mechanism (which is described below), corresponding to the photoconductive drum 2Y.

The temporary toner storing mechanism 40Y collects residual toner remaining on the surface of the photoconductive drum 2Y. The residual toner includes the above-described regular charge toner T0 (i.e., a negatively charged toner) and an irregular charge toner T1, which is a positively charged toner.

After the transferring operation is completed, leaving residual toner remaining on the surface of the photoconductive drum 2Y, the temporary toner storing mechanism 40Y separates the irregular charge toner T1 from the residual toner remaining on the surface of the photoconductive drum 2Y. According to the above-described operation, the temporary toner storing mechanism 40Y is sometimes referred to as a separating mechanism. The temporary toner storing mechanism 40Y then provides an extra travel passage along the perimeter thereof to give a time delay to the irregular charge toner T1. The time delay is controlled by a brush roller drive 42Y, which is described below with reference to FIG. 4. Thereafter, the irregular charge toner is returned from the temporary toner storing mechanism 40Y to the photoconductive drum 2Y.

The toner collecting mechanism collects the irregular charge toner T1 for the purpose of recycling.

Figure 3B:
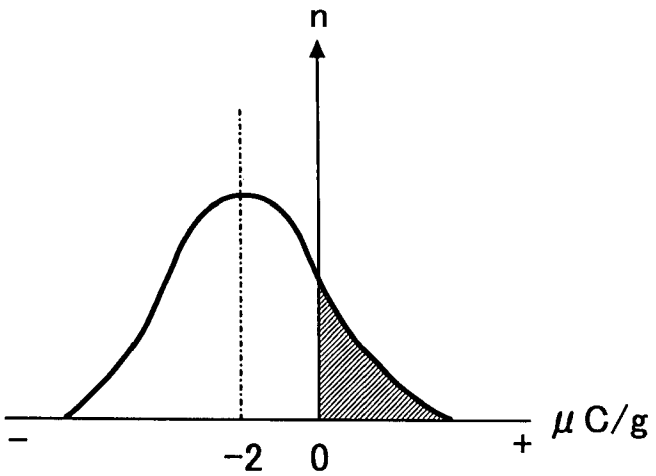
FIG. 3B is a graph showing a distribution of the charged toner remaining on the image bearing member after the charging operation.
Figure 3A:
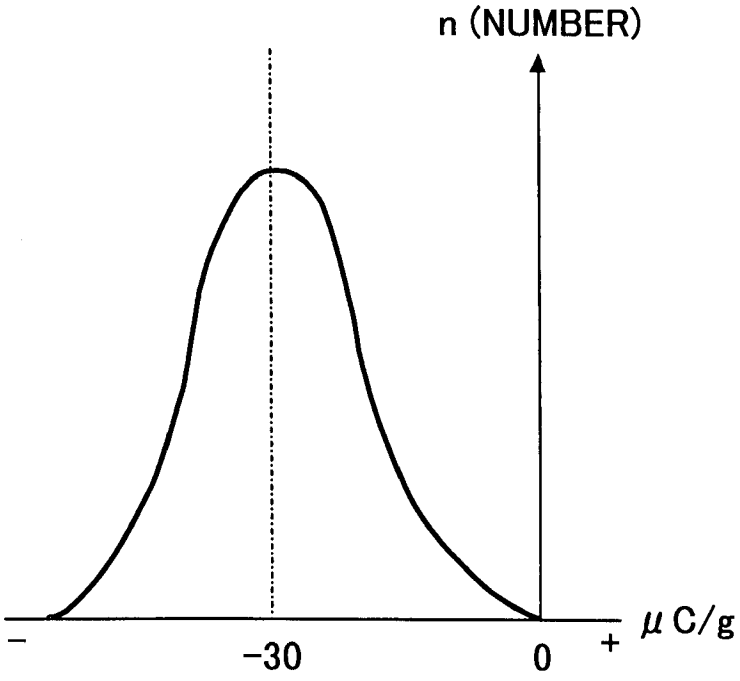
FIG. 3A is a graph showing a distribution of charged toner on the image bearing member before a charging operation of the image forming apparatus of FIG. 1.

Referring now to FIGS. 3A and 3B, the nature of the residual toner is described.

As previously described, the residual toner includes the above-described regular charge toner T0 and the irregular charge toner T1 (i.e., a positively charged toner). FIG. 3A is a graph showing a distribution chart of a toner charge applied on the surface of the photoconductive drum 2Y, for example, before the charged toner is transferred onto the intermediate transfer belt 10. FIG. 3B is a graph showing a distribution chart of a toner voltage remaining on the surface of the photoconductive drum 2Y after the charged toner is transferred onto the intermediate transfer belt 10. As shown in FIG. 3A, the charged toner before being transferred to the intermediate transfer belt 10 is distributed around a toner voltage of −30 μC/g. At this time, the toner on the surface of the photoconductive drum 2Y is charged to a negative polarity, and the toner is defined as the regular charge toner T0. As shown in FIG. 3B, the charged toner after being transferred to the intermediate transfer belt 10 is distributed around a toner voltage of −2 μC/g. A part of the residual toner on the surface of the photoconductive drum 2Y is affected by an irregularly charged bias applied to the primary transfer roller 14Y and the polarity is inverted to a positive polarity, as shown with a shaded portion in FIG. 3B. As a result, among the residual toner, there exists the irregular charge toner T1 which is inverted to the positive charge, as indicated by a line in FIG. 3B.

When the irregular charge toner T1 is conveyed to a charging area formed in the charging device 3Y while it is adhered on the photoconductive drum 2Y, it is electrostatically attracted by an electrostatic force to a surface of the charging roller 3AY, which is applied with the bias to the negative polarity. This may also be caused when the charging roller 3AY is held in contact with the photoconductive drum 2Y and when the charging roller 3AY is placed in a vicinity of the photoconductive drum 2Y. Once the irregular charge toner T1 adheres on the surface of the charging roller 3AY, a value of resistance of the charging roller 3AY and a condition of the surface of the charging roller 3AY may vary, resulting in a toner nonuniformity to a charging start voltage with respect to the photoconductive drum 2Y. In this case, even when the charging roller 3AY is applied with a charge bias having a same amount of voltage as that applied to the surface of the charging roller 3AY with no irregular charge toner, the surface of the photoconductive drum 2Y is not uniformly charged to a desired voltage of, e.g., −500V. As a result, an image density nonuniformity may occur.

If toner adheres on a small part of the surface of the charging roller 3AY, a current generated by the charge bias may become concentrated at a part having no toner thereon. With the above-described condition, when the same charge bias as that applied to the surface of the charging roller 3AY with no irregular charge toner is applied to the charging roller 3AY, a charging potential on the surface of the photoconductive drum 2Y becomes higher than that of a desired potential. As a result, a potential of an area irradiated by the laser beam L emitted by the optical writing device 4 to form an electrostatic latent image may shift to the negative polarity, thereby decreasing the image density. In addition, when the toner adheres on a substantially entire surface of the charging roller 3AY such that the surface of the charging roller 3AY is coated by the toner, a charging ability may deteriorate and the surface potential of the photoconductive drum 2Y may become lower than a desired potential. A potential of an area that does not receive the laser beam L emitted by the optical writing device 4 to form no electrostatic latent image, which is a background area, becomes close to the developing bias applied to the developing roller 5AY. As a result, toner that is not sufficiently charged may adhere on the background area formed on the surface of the photoconductive drum 2Y to cause a background contamination.

On the other hand, the regular charge toner T0 remains in the residual toner. However, when the regular charge toner T0 is conveyed to a portion facing the surface of the charging roller 3AY of the charging device 3Y, if the charging roller 3AY is applied with the charging bias, the regular charge toner T0 may not be transferred onto the surface of the charging roller 3AY. In addition, when the regular charge toner T0 reaches the developing area, it adheres to the carrier to be collected on the developing roller 5AY of the developing device 5Y or it becomes a part of a toner image formed in the image forming operation. Thus, the regular charge toner T0 among the residual toner has less impact in the image forming operation.

Accordingly, it is important to keep the irregular charge toner T1 among the residual toner away from exerting an adverse effect on the image forming process. To prevent the adverse effect, the temporary toner storing mechanism 40Y removes the irregular charge toner T1 of the residual toner before the residual toner remaining on the photoconductive drum 2Y reaches the charging area of the charging roller 3Y.

Figure 4:
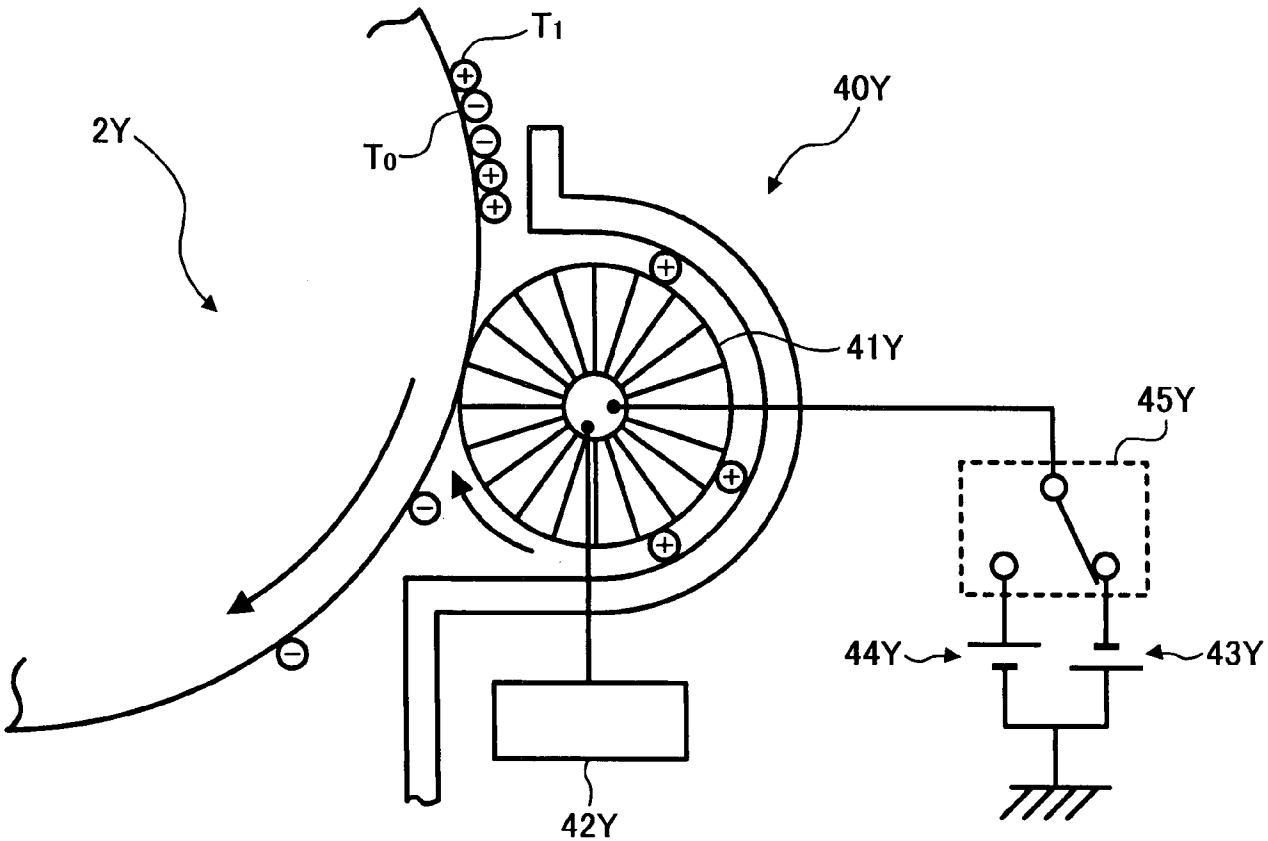
FIG. 4 is a schematic cross-sectional view of a temporary toner storing mechanism provided in the image forming apparatus of FIG. 1.

Referring now to FIG. 4, a temporary toner storing process for temporarily storing the irregular charge toner T1 in the temporary toner storing mechanism 40Y is described. The temporary toner storing mechanism 40Y includes a brush roller 41Y contacting the surface of the photoconductive drum 2Y. The brush roller 41Y contacts or rubs the surface of the photoconductive drum 2Y so that the brush roller 41Y can catch the residual toner remaining on the photoconductive drum 2Y. Although it is preferable to apply a brush roller 41Y (as a roller) for the temporary toner storing mechanism 40Y in this embodiment, an elastic roller may also be applied as an alternative. A brush roller 41Y is better suited to remove toner from a larger area on the surface of the photoconductive drum 2Y than the elastic roller, which can increase collectivity of the residual toner. The brush roller 41Y needs to have a relatively low density of brush. With the low density of brush, a sufficient space for storing the irregular charge toner T1 may be secured inside the brush roller 41Y. Therefore, collectivity of the irregular charge toner T1 may be increased and a discharging process of the irregular charge toner T1 may be decreased. By reducing the density of brush, a mechanical ability of storing the irregular charge toner T1 by the brush roller 41Y may be made small. As a result, the discharging process of the irregular charge toner T1 may smoothly be performed. It is preferable to form the brush roller 41Y to have a brush density in a range from approximately 12,000 flux per inch$^2$ to approximately 858,000 flux per inch$^2$ at a portion around the surface of the brush roller 41Y.

The brush roller 41Y is rotated in a direction of rotation of the photoconductive drum 2Y, as indicated by an arrow shown in FIG. 4, by the brush roller drive 42Y. The brush roller drive 42Y controls a rotation speed of the temporary toner storing mechanism 40Y to be variable to delay the speed of conveying the irregular charged toner T1. The brush roller 41Y may be applied with a predetermined bias by one of a first brush roller power source 43Y and a second brush roller power source 44Y. More particularly, a power source switch 45Y is provided at a portion between the brush roller 41Y and the first and second brush roller power sources 43Y and 44Y to perform an operation for selecting one of the first and second brush roller power sources 43Y and 44Y to be connected to the brush roller 41Y. The power source switch 45Y is controlled by a controlling portion of the image forming apparatus 1. The first brush roller power source 43Y applies a collecting bias so that the surface of the brush roller 41Y is charged to a potential of, e.g., −700V. The second brush roller power source 44Y applies a discharging bias so that the surface of the brush roller 41Y is charged to a potential of, e.g., +200V. With functions of the first and second brush roller power sources 43Y and 44Y, the brush roller 41Y can attract the irregular charge toner T1 when the collecting bias is applied, and can discharge the irregular charge toner T1 when the discharge bias is applied. In the embodiment, the first and second brush roller power sources 43Y and 44Y apply a direct current. However, a power source that applies a voltage generated by a current that includes a direct current and an alternating current may be applied.

The brush roller 41Y is connected to the first brush roller power source 43Y so that the collecting bias is applied to the brush roller 41Y, the surface of the brush roller 41Y is charged with the collecting bias at a potential of, e.g., −700V. The above-described charge is applied before the area with the residual toner remaining on the surface of the photoconductive drum 2Y meets the brush roller 41Y at an area where the surface of the photoconductive drum 2Y contacts the surface of the brush roller 41Y, which is hereinafter referred to as a "brush contact area". Consequently, when the brush roller 41Y charged with the collecting bias contacts the surface of the photoconductive drum 2Y, the irregular charge toner T1 of the residual toner migrates from the surface of the photoconductive drum 2Y to the brush roller 41Y.

More specifically, the photoconductive drum 2Y is uniformly charged to a potential of, e.g., −500V by the charging device 3, and is irradiated by the optical writing device 4 to form an electrostatic latent image having a potential of approximately, e.g., −50V. Further, the photoconductive drum 2Y receives toner on the electrostatic latent image formed on the surface thereof to form a toner image, and then transfers the toner image onto the intermediate transfer belt 10. At this time, the potential of the toner image may be closer to 0V. A large amount of the residual toner stays on the area on the surface of the photoconductive drum 2Y, where the electrostatic latent image has been formed. The irregular charge toner T1, which is charged to the positive polarity, receives the electrostatic force such that the irregular charge toner T1 is attracted, in the brush contact area, to the brush roller 41Y, which is applied with the bias of, e.g., −700V.

In addition, the background area having no toner image also changes the level of its potential from, e.g., −500V to 0V after the transfer process. There is a possibility that the background area may receive a small amount of the residual toner. At this time, the irregular charge toner T1 having the positive polarity on the background area is also attracted by the electrostatic force in the brush contact area, such that the irregular charge toner T1 migrates to the brush roller 41Y. Accordingly, of the residual toner remaining on the surface of the photoconductive drum 2Y, the irregular charge toner T1 may adhere to the brush roller 41Y in the brush contact area.

Next, a discharging process of the irregular charge toner T1 is described. The irregular charge toner T1 collected by the brush roller 41Y is discharged onto the surface of the photoconductive drum 2Y.

The irregular charge toner T1 is collected once by the brush roller 41Y and is then discharged onto the surface of the photoconductive drum 2Y, in synchronization with a predetermined point during a non-image forming operation performed by the image forming apparatus 1. For example, the discharge may be performed after a last sheet of a print job is output or may be performed every time a predetermined number of sheets are printed in a print job for producing a great amount of printouts.

Specifically, when the discharge is performed after a last sheet of a print job is output, the irregular charge toner T1 that is generated during an image forming operation is collected, and is discharged in the next image forming operation, before the area of the surface of the photoconductive drum 2Y to be charged by the charging device 3 meets the brush contact area. The above-described discharge of the irregular charge toner T1 may help collect the irregular charge toner T1 without disturbing the next image forming operation.

When the image forming operation is sequentially performed every time a predetermined number of sheets are printed in a print job for producing a great number of printouts, the irregular charge toner T1 held by the brush roller 41Y is collected, after the last image forming operation in the sequential print job is completed. This prevents the sequential image forming operations from being performed for a longer period of time.

The surface of the photoconductive drum 2Y having the irregular charge toner T1 that is discharged as described above includes a remaining potential applied in the last image forming process. The remaining potential is approximately, e.g., −50V. When discharging the potential, the first brush roller power source 43Y connected to the brush roller 41Y is switched to the second brush roller power source 44Y. At this time, the discharge bias is applied to the brush roller 41Y so that the surface of the brush roller 41Y is charged to a potential of, e.g., +20V. When the above-described discharge bias is applied, the irregular charge toner T1 held on the brush roller 41Y receives the electrostatic force such that the irregular charge toner T1 is attracted to the photoconductive drum 2Y having a potential of, e.g., −50V. Accordingly, the irregular charge toner T1 held on the brush roller 41Y migrates to the surface of the photoconductive drum 2Y in the brush contact area.

Next, a collecting process of the irregular charge toner T1 is described. The irregular charge toner T1 is discharged from the brush roller 41Y to the photoconductive drum 2Y so that the irregular charge toner T1 adheres onto the surface of the photoconductive drum 2Y.

After the irregular charge toner T1 returns to the surface of the photoconductive drum 2Y, it passes through an area where the photoconductive drum 2Y faces the charging roller 3AY, which is hereinafter referred to as a charging area, and is collected from the photoconductive drum 2Y by the collecting mechanism. The collecting mechanism may be used in a combination with a developing mechanism (i.e., the developing device 5Y) or with a transferring mechanism (i.e., the intermediate transfer belt 10).

The developing mechanism, which serves as a collecting mechanism, operates as described below. When the photoconductive drum 2Y having the irregular charge toner T1 on the surface thereof is in the developing area, an electric field is formed during a regular image forming operation. The electric field attracts the irregular charge toner T1 to migrate from the photoconductive drum 2Y to the developing mechanism.

The developing device 5Y collects the irregular charge toner T1 as described below.

After the irregular charge toner T1 passes through the charging area of the charging roller 3AY, the irregular charge toner T1 is then conveyed to the developing area. Before the irregular charge toner T1 adhering on the surface of the photoconductive drum 2Y arrives the developing area, the developing device 5Y stops a rotation of the developing roller 5AY with a clutch (not shown) provided thereto. The stoppage of the rotation of the developing roller 5AY facilitates adhesion of toner contained in the developing device 5Y onto the photoconductive drum 2Y and prevents an excessive use of the toner. In addition, before the irregular charge toner T1 on the surface of the photoconductive drum 2Y reaches the developing area, a charging bias of, e.g., −300V is applied to the developing roller 5AY of the developing device 5Y serving as the collecting mechanism. The charging bias of, e.g., −300V is a same value as that of the developing bias. Since the surface of the photoconductive drum 2Y is applied with the charging bias of, e.g., −50V when the photoconductive drum 2Y has the irregular charge toner T1 on the surface thereof, an electrostatic force is generated between the photoconductive drum 2Y and the developing roller 5AY to attract the irregular charge toner T1 to migrate to the surface of the developing roller 5AY. Accordingly, the irregular charge toner T1 is collected to the developing roller 5AY.

In the next image forming operation, when the rotation of the developing roller 5AY is started, the irregular charge toner T1 adhering on the surface of the developing roller 5AY is conveyed to the inside of the developing device 5Y, where the irregular charge toner T1 is mixed and agitated to be charged to the regular charge toner T0 so that it can contribute to the developing operation again.

With the above-described collecting mechanism, the image forming apparatus 1 does not need to provide a photoconductive drum cleaning device including a toner collecting tank or a toner recycling conveyance path at a position facing the photoconductive drum 2Y in a passage between the transferring area and the charging area. Further, the temporary toner storing mechanism 40Y arranged at the position is required to temporarily store the irregular charge toner T1 of the residual toner, thereby making a size of the photoconductive drum cleaning device smaller than background cleaning devices.

The irregular charge toner T1 remaining on the charging roller 3AY also needs to be discharged and collected. The image forming apparatus 1 has small fragments such as toner particles detached from carriers, whittled or pulverized fine powder generated by drive or rotation of driving parts and rotating parts provided thereto, dust in the air, and other similar small fragments. These fragments easily adhere on the surface of the charging roller 3AY, which may cause image defects. Especially, the irregular charge toner T1 has a small absolute value and a small electrostatic force with respect to carriers, and disperses from the carriers to flow inside the image forming apparatus 1. Further, the charging roller 3AY is applied with a charging bias opposite to the irregular charge toner T1. When the charging roller 3AY is charged and the photoconductive drum 2Y has the irregular charge toner T1 on the surface thereof, the irregular charge toner T1 may migrate to the surface of the charging roller 3AY.

To avoid the above-described migration of the irregular charge toner T1, the brush roller 41Y is arranged to contact the photoconductive drum 2Y to rub the surface thereof so that the surface of the photoconductive drum 2Y is frictionally charged to the negative polarity, which is opposite to a polarity of the irregular charge toner T1 having the positive polarity. This generates an electric field in the charging area to discharge and collect the irregular charge toner T1 adhering on the charging roller 3AY. The irregular charge toner T1 on the charging roller 3AY is collected at the same time the irregular charge toner T1 on the temporary toner storing mechanism 40Y is collected.

Further, when a bias having the negative polarity is applied to the brush roller 41Y, the photoconductive drum 2Y is applied with a greater potential of the negative polarity and the irregular charge toner T1 on the charging roller 3AY can be discharged. With the above-described bias, when the photoconductive drum 2Y charged to the above-described bias meets the charging area, a greater electric field may be generated between the photoconductive drum 2Y and the charging roller 3AY.

At this time, it is preferable to stop the bias applied to the charging roller 3AY. If the photoconductive drum 2Y is charged, an electric field can be generated in the charging area. However, an electrostatic force to attract the irregular charge toner T1 to the charging roller 3AY may also be generated. It is also preferable to ground the charging roller 3AY so that the negative electric charge remaining on the charging roller 3AY may be eliminated. With the operation as described above, the irregular charge toner T1 may be collected in the charging area and the greater potential may be obtained.

As described above, the electric field formed between the charging roller 3AY and the photoconductive drum 2Y, which is charged by the brush roller 41Y, can attract the irregular charge toner T1 from the charging roller 3AY to the photoconductive drum 2Y for cleaning the charging roller 3AY.

The brush roller 41Y may be made of one of styrene resin, acrylic resin, polyester resin, fluorine containing resin, polyamide resin, and so on. Particularly, polyamide resin is preferable for its high resistance to abrasion and high rigidity. For a preferable effect on a bias application, the brush roller 41Y may further include a conductive impalpable powder for its bristles. Examples of conductive impalpable powders are carbon black particles such as acetylene black, furnace black, and the like, graphite, or metallic powder such as copper, silver, and so on.

Here, the brush roller 41Y is rotated such that the surface of the brush roller 41Y travels in an opposite direction, which is also referred to as a counter direction, to a moving direction of the photoconductive drum 2Y in the brush contact area. With the rotation of the brush roller 41Y, brush tips of the brush roller 41Y can rub the surface of the photoconductive drum 2Y. A toner particle used in the embodiment has an approximately round shape, which provides a high transfer ability and relatively less residual toner on the photoconductive drum 2Y. However, the toner may cause a toner filming when the toner is repeatedly used in a long period of time. Therefore, the brush roller 41Y rubs the surface of the photoconductive drum 2Y to disperse the regular charge toner T0 adhering on the surface of the photoconductive drum 2Y. The dispersion may reduce the adherences of the regular charge toner T0 with respect to the surface of the photoconductive drum 2Y. As a result, the regular charge toner T0, which has passed through the brush contact area, can easily be collected by the developing device 5Y.

The brush roller 41Y may be rotated such that the surface of the brush roller 41Y moves in a same direction to a moving direction of the surface of the photoconductive drum 2Y in the brush contact area. In this case, when a linear velocity of the brush roller 41Y has a different speed from that of the photoconductive drum 2Y, the regular charge toner T0 can be collected by the developing roller 5Y as described above. Compared to the case in which the surfaces of the brush roller 41Y and the photoconductive drum 2Y move in a different direction in the brush contact area, the case in which the surfaces of the brush roller 41Y and the photoconductive drum 2Y move in the same direction can reduce driving loads to both the brush roller 41Y and to the photoconductive drum 2Y. Accordingly, a load torque applied to a driving mechanism such as the brush roller 41Y may be reduced, thereby making the driving mechanism smaller. In addition, a reduction of the load torque to the photoconductive drum 2Y decreases a chance of causing a toner banding so that an image having a high quality may be obtained.

The regular charge toner T0 in the residual toner, however, is charged to a negative polarity, so the regular charge toner T0 receives an electrostatic force such that the regular charge toner T0 migrates to the photoconductive drum 2Y in the brush contact area. Therefore, the regular charge toner T0 keeps adhering on the surface of the photoconductive drum 2Y without being transferred onto the surface of the brush roller 41Y. However, even if the photoconductive drum 2Y passes through the brush contact area with the regular charge toner T0 on the surface thereof, the next image forming operation is not adversely affected, and the toner image may be successfully made in the next image forming operation or the regular charge toner T0 may be collected by the developing device 5.

Thus, in the present invention, the image forming apparatus 1 does not need to include a plurality of cleaning devices corresponding to the photoconductive drums 2Y, 2C, 2M and 2K. Without using the cleaning device, the brush roller 41Y of the temporary toner storing mechanism 40Y temporarily collects and stores the irregular charge toner T1 of the residual toner which remains, for example, on the surface of the photoconductive drum 2Y. This prevents the irregular charge toner T1 from adhering on the surface of the charging roller 3AY. If adhesion of the irregular charge toner T1 is prevented, an amount of a charging start voltage between the charging roller 3AY and the photoconductive drum 2Y does not change, thereby preventing a decrease of the image density, a background contamination, nonuniformity of the image density and so on. In addition, a small amount of toner accumulated on the surface of the charging roller 3AY may also be collected from the charging roller 3AY to the photoconductive drum 2Y. In this case, the brush roller 41Y of the temporary toner storing mechanism 40Y contacts the photoconductive drum 2Y and rubs the surface of the photoconductive drum 2Y, so that the photoconductive drum 2Y is charged to a negative polarity to form an electric field between the charging roller 3AY and the photoconductive drum 2Y. This electric field helps the small amount of toner migrate from the charging roller 3AY to the photoconductive drum 2Y.

Further, the irregular charge toner T1 held by the brush roller 41Y may be discharged and then collected by the collecting mechanism such as the developing device 5Y so that the irregular charge toner T1 may be recycled. With the structure having the above-described brush roller 41Y for collecting the irregular charge toner T1, the image forming apparatus 1 does not need to include a toner collecting tank for collecting the toner removed from the photoconductive drum 2Y, thereby making the image forming apparatus 1 smaller in size. Further, the above-described structure contributes to a great reduction of space in a tandem-type image forming apparatus including four photoconductive drums arranged in parallel, when compared to a device in which the tandem-type image forming apparatus includes four toner collecting tanks corresponding to the number of the photoconductive drums.

When the image forming operation is suspended due to a paper jam that occurred during a stoppage of a transfer sheet, a great amount of toner adhering on the surface of the photoconductive drum 2Y needs to be removed. In this case, the toner is transferred from the surface of the photoconductive drum 2Y onto the intermediate transfer belt 10 in synchronization with a restart of the image forming operation to be removed by the belt cleaning device 15 provided in contact with a portion of the intermediate transfer belt 10. In this embodiment, the belt cleaning device 15 of the image forming apparatus 1 includes both a fur brush (not shown) and a cleaning blade (also not shown). Thus, the great amount of toner conveyed by the intermediate transfer belt 10 may smoothly be removed. After the toner is removed from the intermediate transfer belt 10, the toner remaining on the surface of the photoconductive drum 2Y is collected by the temporary toner storing mechanism 40Y and the collecting mechanism of the developing device 5Y.

Figure 5:
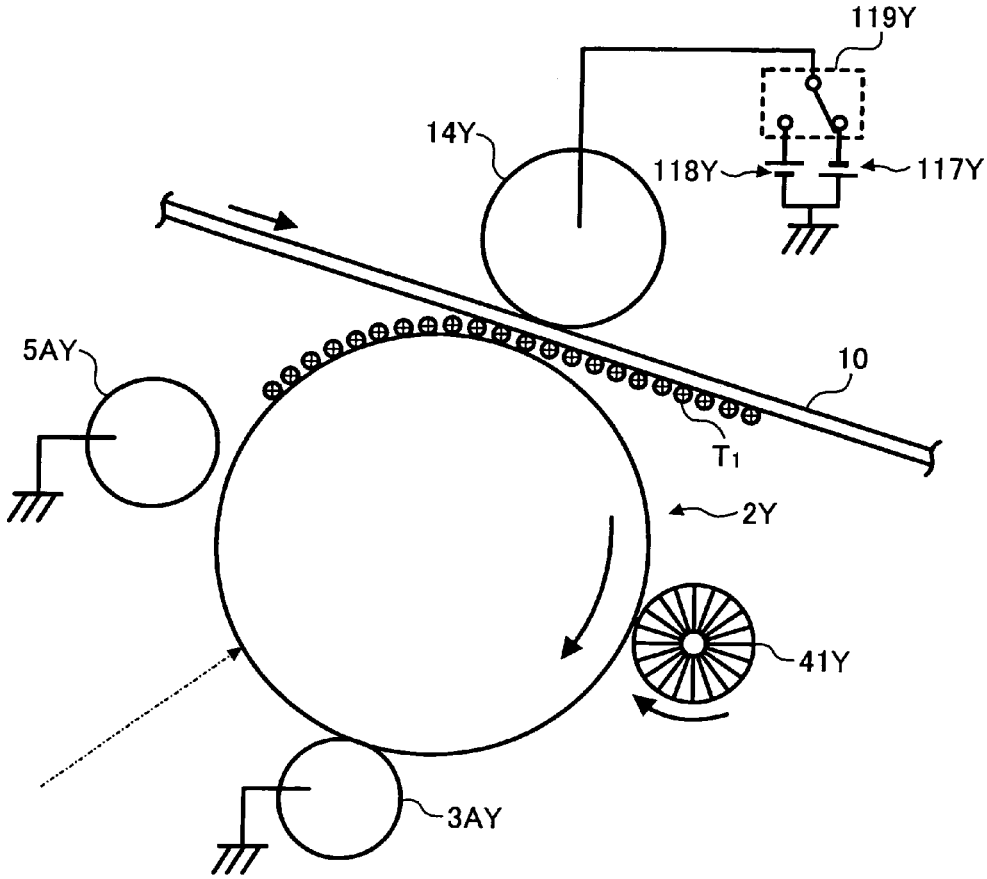
FIG. 5 is a schematic cross-sectional view of a portion around a primary transfer nip formed between an intermediate transfer belt and the image bearing member of the image forming apparatus of FIG. 1.

Referring now to FIG. 5, another exemplary embodiment of the present invention is described. In this embodiment, the transferring device 6 is used as the collecting mechanism, instead of the developing device 5, to collect the irregular charge toner T1 discharged from the brush roller 41Y. In the transferring device 6, the toner is collected by the belt cleaning device 15, which generally cleans off the surface of the intermediate transfer belt 10.

FIG. 5 shows a structure around the primary transfer nip formed between the photoconductive drum 2Y and the primary transfer roller 14Y in the image forming apparatus 1. In the primary transfer nip, the irregular charge toner T1 is collected by the belt cleaning device 15 of the intermediate transfer belt 10. Before the irregular charge toner T1 on the surface of the photoconductive drum 2Y reaches the charging area of the charging roller 3AY, the charging bias is stopped from being applied to the charging roller 3AY. The stoppage of the charging bias prevents adhesion of the irregular charge toner T1 on the charging roller 3AY, so that the irregular charge toner T1 successfully passes through the charging area. Before the irregular charge toner T1 reaches the developing area, the developing bias is stopped from being applied to the developing roller 5AY, which makes the developing roller 5AY be grounded and the potential of the surface thereof may become approximately 0V. Since the photoconductive drum 2Y having the irregular charge toner T1 on the surface thereof has a potential of approximately, e.g., −50V, an electrostatic force is generated in the developing area to attract the irregular charge toner T1 so that the irregular charge toner T1 migrates to the photoconductive drum 2Y in the developing area. Accordingly, the irregular charge toner T1 passes through the developing area without adhering on the developing roller 5AY.

Thus, the irregular charge toner T1 which has passed through the developing area is conveyed to the primary transfer nip formed between the photoconductive drum 2Y and the intermediate transfer belt 10. Before the irregular charge toner T1 on the surface of the photoconductive drum 2Y reaches the primary transfer nip, the primary transfer roller 14 is applied with a bias opposite to that charged during the image forming operation. The primary transfer roller 14 may be applied with a bias from one of a transfer power source 117Y and a second transfer power source 118Y. A power source switch 119Y is provided between the primary transfer roller 14 and the first and second transfer power sources 117Y and 118Y so that the power source switch 119Y may select a transfer power source to be connected to the primary transfer roller 14. The power source switch 119Y is controlled by a controller of the image forming apparatus 1. The first transfer power source 117Y applies a transfer bias of −300V. The second transfer power source 118Y applies different biases to the respective primary transfer rollers 14Y, 14C, 14M and 14K. These biases are in a range from +400V to +2000V. In a transfer process of a regular image forming operation, the second transfer power source 118Y is connected to the primary transfer roller 14, and in a collecting process for collecting the irregular charge toner T1 from the surface of the photoconductive drum 2Y, the first transfer power source 117Y is connected to the primary transfer roller 14.

In the collecting process, a negative bias is applied to the primary transfer roller 14Y so that a transfer electric field is generated between the surface of the photoconductive drum 2Y having the irregular charge toner T1 charged by a transfer bias of, e.g., −50V and the intermediate transfer belt 10. With the transfer electric field, an electrostatic force is generated to attract the irregular charge toner T1 to the intermediate transfer belt 10. Accordingly, the irregular charge toner T1 is transferred onto the surface of the intermediate transfer belt 10. After the irregular charge toner T1 is transferred onto the intermediate transfer belt 10, the irregular charge toner T1 is conveyed to a secondary transfer nip formed between the photoconductive drum 2Y and a secondary transfer roller 16 (FIG. 1). Before the irregular charge toner T1 reaches the secondary transfer nip, the secondary transfer roller 16 is applied with a transfer bias, which is the same as the transfer bias applied in a regular image forming operation, which is a positive bias.

On the other hand, since a potential of the surface of the intermediate transfer belt 10 having the irregular charge toner T1 thereon is approximately 0V in the secondary transfer nip, an electrostatic force is generated to attract the irregular charge toner T1 to the intermediate transfer belt 10. Accordingly, the irregular charge toner T1 passes through the secondary transfer nip without moving onto the surface of the secondary transfer roller 16.

In this embodiment, adhesion of the irregular charge toner T1 to the secondary transfer roller 16 is prevented by applying a bias to the secondary transfer roller 16 when the irregular charge toner T1 passes through the secondary transfer nip. However, as an alternative, another method may be used. For example, the secondary transfer roller 16 may be separately provided with respect to the intermediate transfer belt 10 so that the secondary transfer roller 16 can be separated from the intermediate transfer roller 16 forming a gap therebetween when the irregular charge toner T1 passes through the secondary transfer nip.

After the irregular charge toner T1 passes through the secondary transfer nip as described above, the irregular charge toner T1 is conveyed to a cleaning area where the intermediate transfer belt 10 faces the belt cleaning device 15. In the cleaning area, the irregular charge toner T1 on the intermediate transfer belt 10 is distributed by the fur brush and is removed by the cleaning blade, so that the irregular charge toner T1 is collected to the belt cleaning device 15.

As described above, the irregular charge toner T1 that is discharged from the brush roller 41Y is transferred to the intermediate transfer belt 10 and is then collected from the surface of the photoconductive drum 2Y in this embodiment. With the above-described structure, the image forming apparatus 1 does not need to separately provide toner collecting tanks for collecting toners removed from the photoconductive drums 2Y, 2C, 2M and 2K, thereby reducing the size of the image forming apparatus 1. Especially, a tandem-type image forming apparatus that includes four photoconductive drums 2Y, 2C, 2M and 2K may be greatly reduced in size, compared to a tandem-type image forming apparatus that has separate toner collecting tanks corresponding to the photoconductive drums 2Y, 2C, 2M and 2K.

In this embodiment, the irregular charge toner T1 on the intermediate transfer belt 10 is collected by the belt cleaning device 15. However, as an alternative, another method may be applied. For example, before the irregular charge toner T1 on the intermediate transfer belt 10 reaches the secondary transfer nip, the secondary transfer roller 16 can be applied with a bias opposite to that applied in a regular image forming operation. Therefore, the irregular charge toner T1 may be transferred onto the secondary transfer roller 16 in the secondary transfer nip. In this case, a cleaning device is required for cleaning the surface of the secondary transfer roller 16. A transfer sheet may be used for collecting the irregular charge toner T1.

Further, the irregular charge toner T1 may be collected by the intermediate transfer belt 10 and by the developing device 5. With the structure as described above, when the irregular charge toner T1 remains on the photoconductive drum 2Y after the irregular charge toner T1 has passed through the developing area of the developing device 5Y, the irregular charge toner T1 can be collected by the intermediate transfer belt 10 in the primary transfer nip. Since the irregular charge toner T1 on the photoconductive drum 2Y is collected in two steps, a collecting ability of the irregular charge toner T1 on the photoconductive drum 2Y is enhanced to perform a better collection of the irregular charge toner T1. With the enhanced collecting ability, the irregular charge toner T1 may sufficiently be collected when a great amount of the irregular charge toner T1 is discharged from the brush roller 41Y. As a result, a degree of discharge of the irregular charge toner T1 from the brush roller 41Y may be reduced.

Further, the image forming apparatus 1 may include a process cartridge in which a plurality of image forming components are integrally mounted therein. For example, a process cartridge for processing a yellow toner image may include at least the photoconductive drum 2Y and the temporary toner storing mechanism 40Y which are integrally mounted therein. The other photoconductive drums 2C, 2M and 2K for processing cyan, magenta and black toner images, respectively, may be separately provided to the image forming apparatus 1, having identical structures to the process cartridge for processing a yellow toner image. The photoconductive drums 2Y, 2C, 2M and 2K may be detachably provided to the image forming apparatus 1. The photoconductive drum 2Y may include one or more image forming components arranged around the photoconductive drum 2Y, such as the developing device 5Y, the temporary toner storing mechanism 40Y, the charging device 3Y and so on, which are integrally mounted. When any one of the image forming components in the process cartridge comes to the end of its life or when it needs maintenance, the process cartridge can be replaced, thereby improving convenience.

Next, the toner used in the image forming apparatus 1 according to the present invention is described.

The present invention has been made focusing on a polarity of toner that greatly depends on a frictional electrostatic chargeability of the toner. A sharp control of a distribution of frictionally charged toner particles can increase the transfer efficiency and reduce the amount of the residual toner. Further, a low ratio of the irregular charge toner T1 can facilitate a stable collection of a larger amount of the residual toner. In general, the smaller the volume-based average particle diameter Dv of the toner, the better the thin line reproducibility of the toner. Therefore, it is preferable that the toner has the volume-based average particle diameter Dv of less than 8 μm. However, the smaller the volume-based average particle diameter of the toner, the worse the developing and cleaning properties of the toner. Therefore, it is preferable that the toner has the volume-based average particle diameter DV of greater than 3 μm.

When twenty percent or more of the toner having the volume-based average particle diameter Dv of less than 2 μm is contained in the developing device 5Y, an amount of extremely small toner on the carriers or the surface of the developing roller 5Y may increase. Therefore, the residual toner except for the extremely small toner cannot sufficiently be held in contact or be frictionally charged with respect to the carriers or the developing roller 5AY and, as a result, the amount of the irregular charge toner T1 increases.

Particle diameter distribution of toner indicated based on a ratio of the volume-based average particle diameter Dv to a number-based average particle diameter Dn is preferably in a range from approximately 1.05 to approximately 1.40. With a sharp control of the distribution of the toner particle diameters, the distribution of the toner charge becomes uniform and the irregular charge toner T1 can be reduced. When the ratio Dv/Dn is greater than 1.40, the amount of the irregular charge toner T1 becomes large and it becomes hard to produce an image having high resolution and high quality. A toner particle having the ratio Dv/Dn less than 1.05 is difficult to produce and is impractical to use. The above-described particle diameter of toner can be measured by, for example, a Coultar counter method using a measuring instrument for measuring particle diameter distribution of toner, such as, Coultar counter multisizer (manufactured by Coulter Electronics Limted). By using the above-described measuring instrument, the particle diameter of toner may be obtained with a 50 μm aperture, by measuring the average of particle diameters of 50,000 toner particles.

It is preferable that a shape factor "SF1" of the toner is in a range from approximately 100 to approximately 180, and the shape factor "SF2" of the toner is in a range from approximately 100 to approximately 180.

Figure 6A:
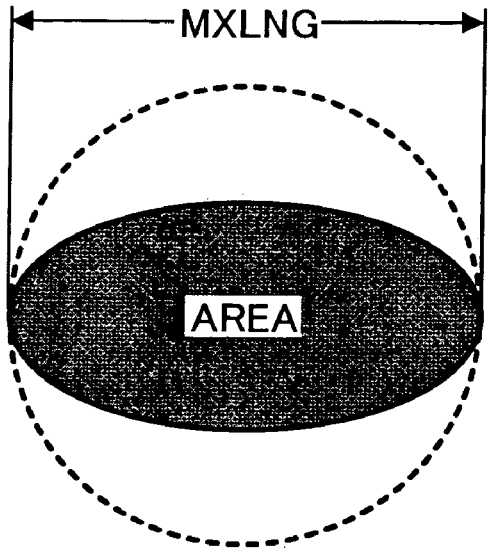
FIG. 6A is a drawing of a toner having an "SF1" shape factor.

Referring to FIG. 6A, the shape factor "SF1" is a parameter representing the roundness of a particle. The shape factor "SF1" of a particle is calculated by a following Equation 1:

$$SF1=\{(MXLNG)^2/AREA\}\times(100\pi/4) \qquad \text{Equation 1,}$$

in which "MXLNG" represents the maximum major axis of an elliptical-shaped figure obtained by projecting a toner particle on a two dimensional plane, and "AREA" represents the projected area of the elliptical-shaped figure.

When the value of the shape factor "SF1" is 100, the particle has a perfect spherical shape. As the value of the "SF1" increases, the shape of the particle becomes more elliptical.

Figure 6B:
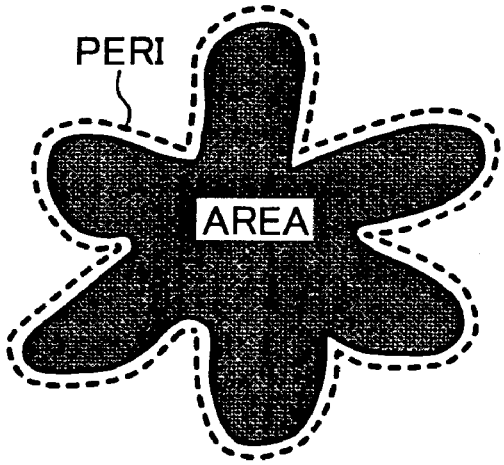
FIG. 6B is a drawing of a toner having an "SF2" shape factor.

Referring to FIG. 6B, the shape factor "SF2" is a value representing irregularity (i.e., a ratio of convex and concave portions) of the shape of the toner. The shape factor "SF2" of a particle is calculated by a following Equation 2:

$$SF2=\{(PERI)^2/AREA\}\times(100\pi/4) \qquad \text{Equation 2,}$$

in which "PERI" represents the perimeter of a figure obtained by projecting a toner particle on a two dimensional plane.

When the value of the shape factor "SF2" is 100, the surface of the toner is even (i.e., no convex and concave portions). As the value of the "SF2" increases, the surface of the toner becomes uneven (i.e., the number of convex and concave portions increases).

In this embodiment, toner images are sampled by using a field emission type scanning electron microscope (FE-SEM) S-800 manufactured by Hitachi, Ltd. The toner image information is analyzed by using an image analyzer (LUSEX3) manufactured by Nireko, Ltd.

As the toner shape becomes spherical, a toner particle becomes held in point-contact with another toner particle or the photoconductive drum 2Y. Under the above-described condition, the toner adhesion force between two toner particles may decrease, resulting in the increase in toner fluidity, and the toner adhesion force between the toner particle and the photoconductive drum 2Y may decrease, resulting in the increase in toner transferability. And, the temporary toner collecting mechanism may easily collect the irregular charge toner T1.

Further, considering collecting performance, it is preferable that the values of the shape factors "SF1" and "SF2" exceed 100. As the values of the shape factors "SF1" and "SF2" become greater, the toner charge distribution becomes greater and a load to the temporary toner storing mechanism becomes greater. Therefore, the values of the shape factors "SF1" and "SF2" are preferably less than 180.

Figure 7A:
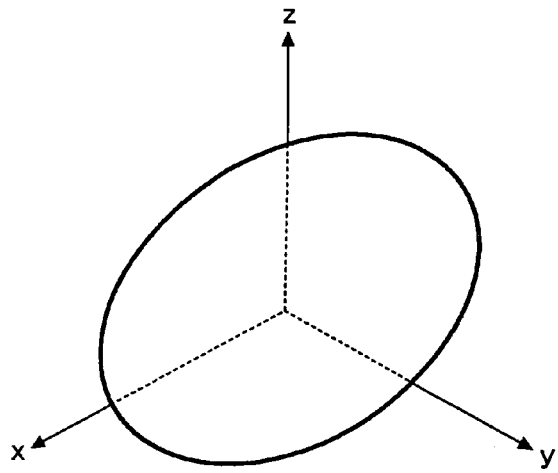
FIG. 7A is a drawing of an outer shape of a toner used in the image forming apparatus of FIG. 1.
Figure 7B:
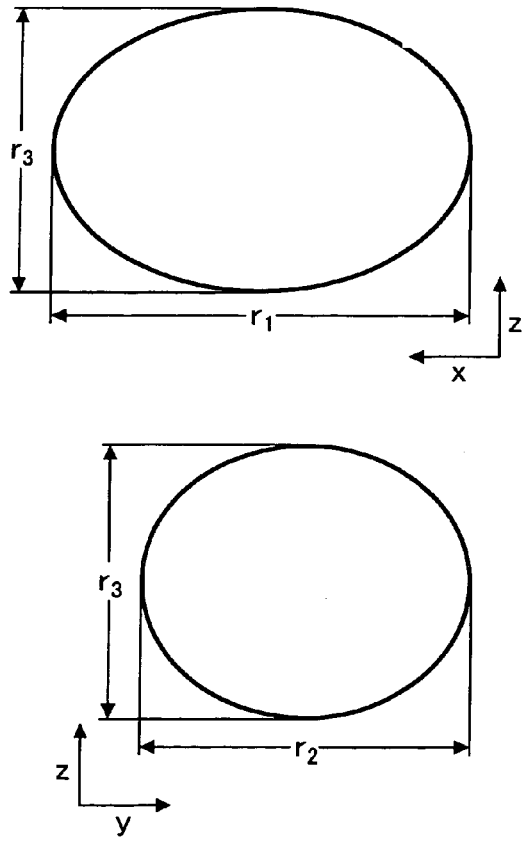
FIG. 7B is a schematic cross-sectional view of the toner, showing major and minor axes and a thickness of the toner of FIG. 7A.

Further, the toner used in the image forming apparatus 1 may be substantially spherical. Referring to FIGS. 7A, 7B and 7C, a size of the toner is described. An axis x of FIG. 7A represents a major axis r1 of FIG. 7B, which is the longest axis of the toner. An axis y of FIG. 7A represents a minor axis r2 of FIG. 7B, which is the second longest axis of the toner. The axis z of FIG. 7A represents a thickness r3 of FIG. 7B, which is a thickness of the shortest axis of the toner. The toner has a relationship between the major and minor axes r1 and r2 and the thickness r3 as follows:

$$r1 \geqq r2 \geqq r3.$$

The toner of FIG. 7A is preferably in a spindle shape in which the ratio (r2/r1) of the major axis r1 to the minor axis r2 is approximately 0.5 to approximately 0.8, and the ratio (r3/r2) of the thickness r3 to the minor axis is approximately 0.7 to approximately 1.0.

When the ratio (r2/r1) is less than approximately 0.5, the toner has an irregular particle shape, and the value of the toner charge distribution increases.

When the ratio (r3/r2) is less than approximately 0.7, the toner has an irregular particle shape, and the value of the toner charge distribution increases. When the ratio (r3/r2) is approximately 1.0, the toner has a substantially round shape, and the value of the toner charge distribution decreases.

The lengths shown by r1, r2 and r3 can be monitored and measured with scanning electron microscope (SEM) by taking pictures from different angles.

The shape of toner depends on the manufacturing method used. For example, a toner particle produced by a dry type grinding method has an irregular shape with an uneven surface. The irregular-shaped toner, however, can be modified to an approximately round toner by being subjected to a mechanical treatment or a thermal treatment. Toner produced by a method such as a suspension polymerization method and an emulsion polymerization method may have a smooth surface and a perfectly spherical form. In this regard, spherical form can be charged to elliptic form by performing agitating in a middle of reaction, i.e., applying a shearing force to the toner.

Toner constituents and a manufacturing method of the toner of the present invention will be described below.

The toner of this embodiment is typically prepared by dispersing a mixture of toner constituents including at least a polyester prepolymer having an isocyanate group, a polyester, a colorant, and a release agent in an aqueous medium in the presence of a particulate resin to perform a polymerization reaction (such as elongation and/or crosslinking). The toner constituents as described above are dissolved in an organic solvent to prepare a toner constituent solution. The dispersion is reacted with an elongation agent and/or a crosslinking agent in the aqueous medium.

The polyester for use in the toner of the present invention preferably has a functional group, containing a nitrogen atom. Suitable polyesters include reaction products of a polyester prepolymer (A) having an isocyanate group with an amine (B). The polyester prepolymer (A) can be formed from a reaction between a polyester having an active hydrogen atom, which polyester is formed by polycondensation between a polyol (1) and a polycarboxylic acid (2), and a polyisocyanate (3). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (1), diols (1-1) and polyols having 3 or more valences (1-2) can be used. In particular, a diol (1-1) alone or a mixture of a diol (1-1) and a small amount of polyol having 3 or more valences (1-2) is preferably used. Specific examples of the diol (1-1) include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the polyol having 3 valences or more valences (1-2) include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acid (2-1) and polycarboxylic acids having 3 or more valences (2-2) can be used. A dicarboylic acid (2-1) alone, or a mixture of the dicarboxylic acid (2-1) and a small amount of polycarboxylic acid having 3 or more valences (2-2) is preferably used. Specific examples of the dicarboxylic acids (2-1) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between the above-mentioned acids anhydride or lower alkyl ester such as methyl ester, ethyl ester and isopropyl ester.

The polyol (1) and the polycarboxylic acid (2) are mixed such that the equivalent ratio ([OH]/[COOH]) between the hydroxyl group [OH] of the polyol (1) and the carboxylic group [COOH] of the polyol carboxylic acid (2) is typically from 2/1 to 1/1, preferably from 1.5/1 to 1/1 and more preferably from 1.3/1 to 1.02/1.

Specific examples of the polyisocyanate (3) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as .alpha.,.alpha.,.alpha.',.alpha.'-te-tramethylxylylenediisocyanate; isocyanurate; the above-mentioned polyisocyanate blocked with phenol derivatives, oxime and caprolactam; and their combinations.

The polyisocyanate (3) is mixed with a polyester such that the equivalent ratio ([NCO]/[OH]) between the isocyanate group [NCO] of the polyisocyanate (3) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates. The content of the constitutional unit obtained from a polyisocyanate (3) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1–B5)

mentioned above are blocked. Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

Modified polyesters such as the urea-modified polyester (i) can be produced by a method such as one-shot methods and prepolymer methods. The weight-average molecular weight of the urea-modified polyester (i) is not less than 10,000, preferably from 20,000 to 10,000,000 and more preferably from 30,000 to 1,000,000. In addition, the peak molecular weight is preferably from 1,000 to 10,000. When the peak molecular weight is less than 1,000, an elongation reaction tends not to occur and elasticity of the toner is low, hence hot offset resistance of the resultant toner deteriorates. When the peak molecular weight is more than approximately 10,000, fixability is impaired and manufacturing problems may occur for example in the particle formation process or the pulverization process. The number-average molecular weight of the urea-modified polyester (i) is not particularly limited when the after-mentioned unmodified polyester resin (ii) is used in combination. Namely, the weight-average molecular weight of the urea-modified polyester resins has priority over the number-average molecular weight thereof. However, when the urea-modified polyester (i) is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester (i) alone but also the unmodified polyester resin (ii) can be included as a toner binder with the urea-modified polyester (i). A combination thereof improves low temperature fixability of the resultant toner and glossiness of color images produced thereby, and using the combination is more preferable than using the urea-modified polyester (i) alone.

Suitable unmodified polyester resin (ii) includes polycondensation products of a polyol (1) and a polycarboxylic acid (2) similarly to the urea-modified polyester (i). Specific examples of the polyol (1) and the polycarboxylic acid (2) are the same as those for use in the urea-modified polyester (i). Polyester resins modified by a bonding such as urethane bonding other than an urea bonding can be considered to be the unmodified polyester in the present invention. It is preferable that the urea-modified polyester (i) at least partially mixes with the unmodified polyester resin (ii) to improve the low temperature fixability and hot offset resistance of the resultant toner. Therefore, the urea-modified polyester (i) preferably has a structure similar to that of the unmodified polyester resin (ii). A mixing ratio ((i)/(ii)) between the urea-modified polyester (i) and polyester resin (ii) is from 5/95 to 80/20 by weight, preferably from 5/95 to 30/70 by weight, more preferably from 5/95 to 25/75 by weight, and even more preferably from 7/93 to 20/80 by weight. When the weight ratio of the urea-modified polyester (i) is less than 5%, the hot offset resistance deteriorates, and in addition, it is difficult to impart a good combination of high temperature preservability and low temperature fixability of the toner. The peak molecular weight of the unmodified polyester (ii) is generally 1,000 to 10,000, preferably 2,000 to 8,000, and more preferably 2,000 to 5,000. When the peak molecular weight thereof is less than approximately 1,000, heat-resistant storability is impaired. When the peak molecular weight thereof is more than approximately 10,000, low temperature fixability is impaired. When the hydroxyl value thereof is less than approximately 5, it is difficult to impart a good combination of heat resistance storability and low temperature fixability. The acid value of the unmodified polyester (ii) is approximately 1 to approximately 5, and preferable 2 to 4. Since the wax having a high acid value is generally used as a wax component of the toner, it is preferable to use the resin having a low acid value as a toner binder because good charge property and high volume resistivity can be imparted to the resultant toner. Thus, the toner formed from such a wax and a resin is suitable for a two-component toner.

The toner binder preferably has a glass transition temperature (Tg) of from 40° C. to 70° C., and more preferably from 55 C. ° to 65° C. When the glass transition temperature is less than 40° C., the high temperature preservability of the toner deteriorates. When the glass transition temperature is higher than 70° C., the low temperature fixability deteriorates. Due to a combination of the modified polyester such as urea-modified polyester and polyester resin, the toner of the present invention has better high temperature preservability than conventional toners including a polyester resin as a binder resin even though the glass transition temperature is low.

The toner of the present invention preferably includes a wax releasing agent in the vicinity of the surface of the toner particle because the polar group in the modified polyester and the releasing agent cause negative adsorption, and thereby the releasing agent can be stably dispersed. In particular, when toner constituents are dissolved or dispersed in an organic solvent, and the solution or dispersion is dispersed in an aqueous medium to prepare toner particles, the polar group of the modified polyester selectively moves to the surface portion of the toner particles because of having affinity for water. Therefore, the particles of the release agent can be prevented from being exposed. It is preferable that 80% by number or more of the wax particles dispersed in the toner particles is included in a surface portion of the toner particles. This is because wax is sufficiently bled out during fixing and thereby fixing can be performed without using a release oil even when the toner is used as color toners. In addition, since only a small amount of release agent is present on the surface of the toner particles, the toner has good durability, stability, and preservability.

Specially, the ratio of the release agent included in the cross section of a surface portion (from 0 to 1 μm in depth) of toner particles is preferably from 5 to 40% based on total area of the cross section of the surface portion. When the ratio is too small, the toner has poor offset resistance. In contrast, when the content is too large, the toner has poor heat resistance and durability. In this regard, the surface portion is defined as a surface portion having a thickness of 1 μm (i.e., a portion having a depth up to 1 μm from the surface of the toner particles).

The release agent dispersed in the toner particles preferably has a particle diameter distribution such that particles having a particle diameter of from 0.1 to 3 μm are present in an amount not less than 70% by number, and more preferably particles having a particle diameter of from 1 to 2 μm are present in an amount not less than 70% by number. When the content of fine particles is too high, good release property cannot be imparted to the toner. In contrast, when the content of large particles is too high, the toner has poor fluidity because the release agents agglomerate, resulting in formation of a film of the release agent on a photoconductive drum, etc. In addition, when such a toner is used as a color toner, the toner has poor color reproducibility and the toner images have a low gloss.

To control the dispersion state of the release agent in toner particles, it is beneficial that the release agent is dispersed in a medium while the dispersion energy is properly controlled and a proper dispersant is added thereto.

The release agent preferably has an acid value not greater than 5 mgKOH/g because a release agent having too high an acid value has poor releasability. From this point of view, camauba waxes that are subjected to a free-fatty-acid removing treatment, rice waxes, montan ester waxes and ester waxes are preferably used as the release agent in the toner of the present invention.

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol-Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y. Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B. Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1 to 15% by weight, and more preferably from 3 to 10% by weight, based on total weight of the toner.

The colorants mentioned above for use in the present invention can be used as master batch pigments by being combined with a resin.

Specific examples of the resin for use in the master batch pigment or for use as the binder resin to be used in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder prepared by drying the wet cake can also be used as a colorant. In this case, a three roll mill is preferably used for kneading the mixture upon application of high shear stress.

The method for manufacturing the toner is described.

The toner of the present invention can be produced by the following method, but the manufacturing method is not limited thereto.

The aqueous medium for use in the present invention is water alone or a mixture of water with a solvent that can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

In the present invention, the reactive modified polyester such as a polyester prepolymer having an isocyanate group (A) is reacted with the amines (B) in the aqueous medium to form the urea-modified polyester.

To prepare a dispersion in which a modified polyester such as urea-modified polyester or a reactive modified polyester such as a prepolymer (A) is stably dispersed in an aqueous medium, a method in which toner constituents including a modified polyester such as urea-modified polyester or a reactive modified polyester such as a prepolymer (A) are added into an aqueous medium and then dispersed upon application of shear stress is preferably used. A prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method in which particles, which are previously formed without a colorant, are dyed by a known dying method can also be used.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, a urea-modified polyester or a prepolymer (A) can be easily dispersed because the dispersion has a low viscosity.

The content of the aqueous medium is typically from 50 to 2,000 parts by weight, and preferably from 100 to 1,000 parts by weight, per 100 parts by weight of the toner constituents including a urea-modified polyester or a prepolymer (A). When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase. A dispersant can be preferably used when a dispersion is prepared, to prepare a dispersion including particles having a sharp particle diameter distribution and to prepare a stable dispersion.

Various dispersants are used to emulsify and disperse an oil phase in an aqueous liquid including water in which the toner constituents are dispersed. Specific examples of such dispersants include surfactants, inorganic fine-particle dispersants, polymer fine-particle dispersants, etc.

Specific examples of the dispersants include anionic surfactants such as alkylbenzenesulfonic acid salts, .alpha.-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di)octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl(C3–C4) sulfonate, sodium 3-1omega-fluoroalkanoyl (C6–C8)-N-ethylamino}-1-propanesulfonate, fluoroalkyl (C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl-)perfluorooctanesulfone amide, perfluoroalkyl (C6–C10) sulfoneamidepropyltrimethylammonium salts, salts of perfluoroalkyl(C6–C10)-N-ethylsulfonylglycin, monoperfluoroalkyl(C6–C16)e-thylphosphates, etc.

Specific examples of the marketed products of such surfactants having a fluoroalkyl group include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by DainipponInk and Chemicals, Inc.; ECTOP EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6–C10)sulfone-amidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE DS-202 (from Daikin Industries, Ltd.); MEGAFACE® F-150 and F-824 (from Dainippon Ink and Chemicals, Inc.); ECTOP EF-132 (from Tohchem Products Co., Ltd.); FUTARGENT® F-300 (from Neos); etc.

In addition, inorganic compound dispersants such as tricalcium phosphate, calcium carbonate, titanium oxide, colloidal silica and hydroxyapatite which are hardly insoluble in water can also be used.

In addition, particulate polymers can also be used as a dispersant as well as the inorganic dispersants mentioned above. Specific examples of the particulate polymers include particulate polymethyl methacrylate having a particle diameter of from 1 μm and 3 μm, particulate polystyrene having a particle diameter of from 0.5 μm and 2 μm, particulate styrene-acrylonitrile copolymers having a particle diameter of 1 μm, PB-200H (from Kao Corp.), SGP (Soken Chemical & Engineering Co., Ltd.), TECHNOPOLYMER SB (Sekisui Plastics Co., Ltd.), SPG-3G (Soken Chemical & Engineering Co., Ltd.), and MICROPEARL (Sekisui Fine Chemical Co., Ltd.).

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, .alpha.-cyanoacrylic acid, .alpha.-cyanomethacrylic acid, itaconic acid, crotonic acid, fumaric acid, maleic acid and maleic anhydride), acrylic monomers having a hydroxyl group (e.g., .beta.-hydroxyethyl acrylate, .beta.-hydroxyethyl methacrylate, .beta.-hydroxypropyl acrylate, (.beta.-hydroxypropyl methacrylate, .gamma.-hydroxypropyl acrylate, .gamma.-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The prepared emulsified dispersion (reaction product) is gradually heated while stirred in a laminar flow, and an organic solvent is removed from the dispersion after stirred strongly when the dispersion has a specific temperature to from a toner particle having a shape of a spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis. When a dispersing agent is used to prepare a particle dispersion, the dispersing agent can remain on the surface of the toner particle. When a solvent is used to prepare a particle dispersion, the solvent is removed therefrom under a normal or reduced pressure after the particles are subjected to an elongation reaction and/or a crosslinking reaction of the modified polyester (prepolymer) with amine.

The shape of the toner can be properly controlled by the solvent removal conditions. To control the diameter of concavity of the toner, the oil solid content of a liquid emulsified and dispersed in an aqueous medium has to be 5 to 50%, the solvent removal temperature has to be from 10 to 50° C., and further a solvent removal time is not longer than 30 min. This is because the solvent included in the oil phase evaporates in a short time and thereby the comparatively hard and elastic oil phase causes an uneven volume constriction at a low temperature. When the solid content of the oil phase is greater than 50%, the possibility of occurrence of the volume constriction decreases because the amount of the evaporated solvent is small. When the solid content is less than 5%, the productivity of the toner deteriorates. The longer the solvent removing time, the less the possibility or occurrence of the volume constriction. Therefore, the toner particle is ensphered. However, the above-mentioned conditions are not absolute conditions, and the temperature and time are preferably balanced.

Further, to decrease the viscosity of the dispersion including the toner constituents, a solvent that can dissolve the urea-modified polyester or prepolymer (A) can be used. In this case, the resultant particles have a sharp particle diameter distribution. The solvent is preferably volatile and has a boiling point lower than 100° C. because the solvent is easily removed from the dispersion after the particles are formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer (A) used.

The elongation and/or crosslinking reaction time is determined depending on the reactivity of the isocyanate structure of the prepolymer (A) and amine (B) used, but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used. The amines (B) are used as the elongation agent and/or crosslinker.

In the present invention, the solvent in the dispersion is preferably removed therefrom at 10 to 50° C. after the elongation and/or crosslinking reaction. At this time, the emulsion is preferably stirred strongly in a stirring tank having no baffle nor protrusion on an inside surface thereof to control the shape of the dispersed particles. To carry out this stirring process before removing the solvent can control the shape of the toner. The emulsified liquid is strongly stirred in the stirring tank without baffle and protrusion at 30 to 50° C. to confirm that a spindle-shaped toner particle is processed, and then the solvent is removed at 10 to 50° C. This is not an absolute condition and the condition has to be properly controlled. However, it is supposed that the shape of the toner particle changes to a spindle shape from a sphere because the solvent included in the liquid decreases viscosity of the emulsified liquid and a stronger stirring force is applied to the toner particle.

The volume-based average particle diameter (Dv) of the toner, the number-based average particle diameter (Dn) thereof, and the ratio (Dv/Dn) can be controlled by controlling the viscosity of the aqueous phase and the oil phase, and properties and addition quantity of the resin particles used, etc.

Numerous additional modifications and variations are possible in light of the above teachings. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus, comprising:

an image bearing member configured to form an electrostatic latent image on a surface thereof; and a separating mechanism configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member, in synchronization with a predetermined point during a non-image forming operation.

2. The image forming apparatus according to claim 1, further comprising:

a charging member configured to supply a charging bias to the surface of the image bearing member; and a collecting mechanism configured to collect the irregular charge toner returned from the separating mechanism after the irregular charge toner passes a charging area formed between the charging member and the image bearing member.

3. The image forming apparatus according to claim 2, wherein the irregular charge toner has a positive polarity.

4. The image forming apparatus according to claim 2, wherein the irregular charge toner has a negative polarity.

5. The image forming apparatus according to claim 2, further comprising:

a drive mechanism configured to drive the separating mechanism in a direction of rotation of the image bearing member, the drive mechanism controlling a rotation speed of the separating mechanism to be variable.

6. The image forming apparatus according to claim 5, wherein the separating mechanism includes a brush roller having a peripheral surface including the extra travel passage, and wherein a part of the peripheral surface is held in contact with the surface of the image bearing member.

7. The image forming apparatus according to claim 6, further comprising:

a power source configured to supply a collecting bias to the brush roller so that the irregular charge toner is attracted to the separating mechanism, and to supply a discharging bias to the brush roller so that the irregular charge toner is returned to the image bearing member.

8. The image forming apparatus according to claim 6, wherein the brush roller rubs the surface of the image bearing member while the brush roller rotates in a direction of rotation of the image bearing member.

9. The image forming apparatus according to claim 2, wherein the separating mechanism applies a predetermined bias to the image bearing member so that the irregular charge toner deposited to the charging member is released therefrom to the image bearing member.

10. The image forming apparatus according to claim 9, wherein the charging member stops supplying the charging bias when the separating mechanism applies the predetermined bias to the image bearing member.

11. The image forming apparatus according to claim 9, wherein the charging member is earth grounded when the separating mechanism applies the predetermined bias to the image bearing member.

12. The image forming apparatus according to claim 2, further comprising:

a developing mechanism configured to develop a toner image based on the electrostatic latent image formed on the surface of the image bearing member; and a transferring mechanism configured to transfer the toner image from the image bearing member, wherein at least one of the developing mechanism and the transferring mechanism includes the collecting mechanism.

13. The image forming apparatus according to claim 12, wherein the transferring mechanism comprises a cleaning mechanism configured to clean off a surface of the transferring mechanism when the transferring mechanism includes the collecting mechanism and collects the irregular charge toner.

14. The image forming apparatus according to claim 1, wherein the image bearing member and the separating mechanism are integrally formed in a detachable process cartridge.

15. An image forming apparatus, comprising:

means for bearing an electrostatic latent image on a surface thereof; and means for separating an irregular charge toner from a residual toner remaining on the surface of the means for bearing after a completion of an image forming process, for providing an extra travel passage to give a time delay to the irregular charge toner, and for returning the irregular charge toner with the time delay to the surface of the means for bearing, in synchronization with a predetermined point during a non-image forming operation.

16. The image forming apparatus according to claim 15, further comprising:

means for supplying a charging bias to the surface of the means for bearing; and means for collecting the irregular charge toner returned from the means for separating after the irregular charge toner passes a charging area formed between the means for charging and the means for bearing.

17. The image forming apparatus according to claim 16, wherein the irregular charge toner has a positive polarity.

18. The image forming apparatus according to claim 16, wherein the irregular charge toner has a negative polarity.

19. The image forming apparatus according to claim 16, further comprising:

means for driving the means for separating in a direction of rotation of the means for bearing, the means for driving controlling a rotation speed of the means for separating to be variable.

20. The image forming apparatus according to claim 19, wherein the means for separating includes a brush roller having a peripheral surface including the extra travel passage, and wherein a part of the peripheral surface is held in contact with the surface of the means for bearing.

21. The image forming apparatus according to claim 20, further comprising:

means for supplying a collecting bias to the brush roller so that the irregular charge toner is attracted to the means for separating, and for supplying a discharging bias to the brush roller so that the irregular charge toner is returned to the image bearing member.

22. The image forming apparatus according to claim 20, wherein the brush roller rubs the surface of the bearing means while the brush roller rotates in a direction of rotation of the means for bearing.

23. The image forming apparatus according to claim 16, wherein the means for separating applies a predetermined bias to the means for bearing so that the irregular charge toner deposited to the means for charging is released therefrom to the means for bearing.

24. The image forming apparatus according to claim 23, wherein the means for charging stops supplying the charging bias when the means for separating applies the predetermined bias to the means for bearing.

25. The image forming apparatus according to claim 23, wherein the means for charging is earth grounded when the means for separating applies the predetermined bias to the means for bearing.

26. The image forming apparatus according to claim 16, wherein the means for collecting comprises at least one of:

means for developing a toner image based on the electrostatic latent image formed on the surface of the means for bearing; and means for transferring the toner image from the means for bearing.

27. The image forming apparatus according to claim 26, wherein the means for transferring comprises means for cleaning off a surface of the means for transferring when the means for transferring includes the means for collecting and collects the irregular charge toner.

28. The image forming apparatus according to claim 15, wherein the means for bearing and the means for separating are integrally formed in a detachable process cartridge.

29. A method for image forming, comprising:

separating an irregular charge toner from a residual toner remaining on a surface of an image bearing member after a completion of an image forming process;

giving a time delay to the irregular charge toner; and returning the irregular charge toner with the time delay to the surface of the image bearing member, in synchronization with a predetermined point during a non-image forming operation.

30. The method according to claim 29, further comprising:

charging the surface of the image bearing member with a charging bias; and collecting the irregular charge toner after the irregular charge toner passes a charging area formed between the charging member and the image bearing member.

31. The method according to claim 30, wherein the irregular charge toner has a positive polarity.

32. The method according to claim 30, wherein the irregular charge toner has a negative polarity.

33. The method according to claim 30, further comprising:

driving for performing the separating in a direction of rotation of the image bearing member; and controlling a rotation speed in the separating to be variable.

34. The method according to claim 33, wherein the separating separates the irregular charge toner with a brush roller having a surface portion held in contact with a surface of the image bearing member.

35. The method according to claim 34, further comprising:

supplying a collecting bias to the brush roller so that the irregular charge toner is attracted in the separating, and supplying a discharging bias to the brush roller so that the irregular charge toner is returned to the image bearing member.

36. The method according to claim 34, wherein the brush roller rubs the surface of the image bearing member while the brush roller rotates in a direction of rotation of the image bearing member.

37. The image forming apparatus according to claim 30, wherein the separating applies a predetermined bias to the image bearing member so that the irregular charge toner deposited to the charging member is released therefrom to the image bearing member.

38. The method according to claim 37, wherein the supplying stops supplying the charging bias when the separating applies the predetermined bias to the image bearing member.

39. The method according to claim 29, further comprising:

developing, with a developing mechanism, a toner image based on the electrostatic latent image formed on the surface of the image bearing member; and transferring, with a transferring mechanism, the toner image from the image bearing member, wherein at least one of the developing and the transferring performs the collecting.

40. The method according to claim 39, wherein the transferring mechanism includes a cleaning mechanism configured to clean off a surface of the transferring mechanism when the transferring mechanism performs the collecting and collects the irregular charge toner.

41. The method according to claim 29, wherein the separating, giving, and returning are performed in a detachable process cartridge.

42. An image forming apparatus, comprising:

an image bearing member configured to bear a toner image using a toner on a surface thereof; and a separating mechanism configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member, in synchronization with a predetermined point during a non-image forming operation, wherein the toner has a volume-based average particle diameter Dv in a range from approximately 3 μm to approximately 8 μm and a distribution Ds in a range from approximately 1.05 to approximately 1.40, wherein the distribution Ds is defined by a ratio of the volume-based average particle diameter Dv to a number-based average particle diameter Dn, expressed as Dv/Dn.

43. The image forming apparatus according to claim 42, wherein the toner has a first shape factor SF1 in a range of approximately 100 to approximately 180 and a second shape factor SF2 in a range of approximately 100 to approximately 180.

44. The image forming apparatus according to claim 43, wherein the toner has a spindle shape.

45. The image forming apparatus according to claim 44, wherein the toner has a ratio of a major axis r1 to a minor axis r2 in a range from approximately 0.5 to approximately 1.0 and a ratio of a thickness r3, perpendicular to the major axis and minor axis, to the minor axis r2 m a range from approximately 0.7 to approximately 1.0, and satisfies a relationship of r3>r1>r2.

46. A process cartridge for use in an image forming apparatus, comprising:

an image bearing member configured to form an electrostatic latent image on a surface thereof and a separating mechanism configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member, in synchronization with a predetermined point during a non-image forming operation.

47. A toner used in an image forming apparatus, comprising:

a resin;

a colorant;

a charge control agent; and a releasing agent, wherein the toner has a volume-based average particle diameter Dv in a range from approximately 3 μm to approximately 8 μm and a distribution Ds in a range from approximately 1.05 to approximately 1.40, wherein the distribution Ds is defined by a ratio of the volume-based average particle diameter Dv to the number-based average particle diameter Dn, expressed as Dv/Dn; and wherein the image forming apparatus comprises:

an image bearing member configured to form an electrostatic latent image on a surface thereof; and a separating mechanism configured to separate an irregular charge toner from a residual toner remaining on the surface of the image bearing member after a completion of an image forming process, to provide an extra travel passage to give a time delay to the irregular charge toner, and to return the irregular charge toner with the time delay to the surface of the image bearing member, in synchronization with a predetermined point during a non-image forming operation.

48. The toner according to claim 47, wherein the toner has a first shape factor SF1 in a range of approximately 100 to approximately 180 and a second shape factor SF2 in a range of approximately 100 to approximately 180.

49. The toner according to claim 48, wherein the toner has a spindle shape.

50. The toner according to claim 49, wherein the toner has a ratio of a major axis r1 to a minor axis r2 in a range from approximately 0.5 to approximately 1.0 and a ratio of a thickness r3, perpendicular to the major axis and the minor axis, to the minor axis r2 in a range from approximately 0.7 to approximately 1.0, and satisfies a relationship of r3>r1>r2.

* * * * *